US009200607B2

(12) United States Patent
Wilson

(10) Patent No.: US 9,200,607 B2
(45) **Date of Patent: *Dec. 1, 2015**

(54) APPARATUS FOR SPRAY INJECTION OF LIQUID OR GAS

(71) Applicant: Steven Wilson, Hamburg, PA (US)

(72) Inventor: Steven Wilson, Hamburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/538,147

(22) Filed: Nov. 11, 2014

(65) Prior Publication Data

US 2015/0059704 A1 Mar. 5, 2015

Related U.S. Application Data

(60) Continuation-in-part of application No. 14/053,987, filed on Oct. 15, 2013, which is a division of application No. 12/327,028, filed on Dec. 3, 2008, now Pat. No. 8,555,866.

(60) Provisional application No. 61/005,281, filed on Dec. 4, 2007.

(51) Int. Cl.

| | |
|---|---|
| ***F02M 19/00*** | (2006.01) |
| ***F02M 69/50*** | (2006.01) |
| ***B05B 7/08*** | (2006.01) |
| ***F02M 19/03*** | (2006.01) |

(52) U.S. Cl.

CPC ..... *F02M 69/50* (2013.01); *B05B 7/0815* (2013.01); *F02M 19/03* (2013.01)

(58) Field of Classification Search

CPC ..... F02M 19/00; F02M 25/00
USPC ..... 123/445, 463, 473, 585, 586, 590; 261/115–118

See application file for complete search history.

(56) References Cited

U.S. PATENT DOCUMENTS

| | | | |
|---|---|---|---|
| 622,482 | A | 4/1899 | Jackson |
| 1,627,727 | A | 5/1927 | Charter |
| 2,482,864 | A | 9/1949 | Nemnich |
| 3,182,646 | A | 5/1965 | Kuechenmeister |
| 3,610,213 | A | 10/1971 | Gianini |
| 4,157,084 | A | 6/1979 | Wallis |

(Continued)

OTHER PUBLICATIONS

Product Catalog, "NX Nitrous Express Next Generation Nitrous System", vol. 6.1, pp. 48-49 (4 pages), Nitrous Express Inc., Wichita Falls, TX.

(Continued)

*Primary Examiner* — Lindsay Low
*Assistant Examiner* — Kevin Lathers
(74) *Attorney, Agent, or Firm* — Volpe and Koenig, P.C.

(57) ABSTRACT

An injection gate is provided for high pressure, high velocity secondary fluid for admixture of an atomized spray thereof with another or primary fluid that atomizes the other fluid. The secondary fluid may be an accelerant and the primary fluid may be a low pressure fuel or fuel/air mixture in a fuel injection arrangement for an internal combustion engine. An injection plate assembly for an engine is interposed between the carburetor and the manifold), with an array of accelerant injection gates grouped with an array of fuel or fuel/air gates about an aperture coinciding with a throttle bore and evenly balancing the spray about the throttle bore, creating an atomized admixture of accelerant/fuel. The injection of accelerant is directed sharply downwardly toward the center of the bore and through the injected fuel stream, atomizing the fuel thereof for a high efficiency boost of horsepower.

9 Claims, 19 Drawing Sheets

(56) References Cited

U.S. PATENT DOCUMENTS

| | | | | |
|---|---|---|---|---|
| 4,211,200 | A | 7/1980 | Rocchio et al. | |
| 4,355,623 | A | 10/1982 | Graham | |
| 4,494,488 | A | 1/1985 | Wheatley | |
| 4,572,140 | A | 2/1986 | Wheatley | |
| 4,628,890 | A | 12/1986 | Freeman | |
| 4,672,940 | A | 6/1987 | Nakayama et al. | |
| 4,674,466 | A | 6/1987 | Jung-Kwang | |
| 4,683,843 | A | 8/1987 | Norcia et al. | |
| 4,798,190 | A | 1/1989 | Vaznaian et al. | |
| 4,827,888 | A | 5/1989 | Vaznaian et al. | |
| 5,269,275 | A | 12/1993 | Dahlgren | |
| 5,287,828 | A | 2/1994 | Kennedy | |
| 5,449,120 | A | 9/1995 | Tani et al. | |
| 5,482,079 | A | 1/1996 | Bozzelli | |
| 5,699,776 | A | 12/1997 | Wood et al. | |
| 5,743,241 | A | 4/1998 | Wood et al. | |
| 5,839,418 | A | 11/1998 | Grant | |
| 5,930,999 | A | 8/1999 | Howell et al. | |
| 6,378,512 | B1 * | 4/2002 | Staggemeier | 123/585 |
| 6,935,322 | B2 * | 8/2005 | Grant | 123/585 |
| 2008/0110436 | A1 | 5/2008 | Baasch et al. | |

OTHER PUBLICATIONS

Product Catalog, "Nitrous Pro-Flow", vol. XIV, pp. 16-17, Wilson Manifolds, Ft. Lauderdale, FL.

Product Catalog, "NOS 2000 Catalog", pp. 14, 17, 28, 36, 49, (2000); Nitrous Oxide Systems, Costa Mesa, CA.

Product Catalog, "Zex, Performance Catalog", ZEX 101-05, pp. 6,10, 2005; Zex Performance Products, Memphis, TN.

* cited by examiner

APPARATUS FOR SPRAY INJECTION OF LIQUID OR GAS

INCORPORATION BY REFERENCE

The following documents are incorporated herein by reference as if fully set forth: U.S. patent application Ser. No. 14/053,987, filed Oct. 15, 2013; U.S. patent application Ser. No. 12/327,028, filed Dec. 3, 2008; and U.S. Provisional Patent Application No. 61/005,281, filed Dec. 4, 2007.

FIELD OF THE INVENTION

This relates to the field of spray injection such as for fuel injection for internal combustion engines.

BACKGROUND OF THE INVENTION

Internal combustion automotive engines with carburetor or throttle body fuel injection mechanisms are well known, for injection of fuel in atomized form for admixture thereof with air in the carburetor or throttle body fuel injection. Typically, such carburetors have a plate system that utilizes either a central spray bar or direct gate injection nozzles or a perimeter plate. Also, engines are known in which an accelerant is admixed with an air/fuel mixture at an injection point for injection into an engine's intake manifold; the accelerant is subjected to very high pressure relative to the pressure of the air/fuel mixture, so that the high velocity accelerant atomizes the air/fuel mixture when its stream combines with the air/fuel stream. Injection nozzles for such purpose are disclosed in U.S. Pat. No. 4,798,190 and in U.S. Pat. No. 5,699,776 wherein two intake ports are provided in a nozzle with separate but substantially parallel passageways extending to a common output port where atomization and admixture occur. Such output ports are enlarged, and many are also chamfered or bell-shaped, to permit expansion of the atomized flow as it is emitted into the entrance into the manifold.

In U.S. Pat. No. 4,798,190, the air/fuel intake port is in fluid communication with an inner cylinder providing a passageway therefor extending to the output port, while the accelerant intake port is in fluid communication with a passageway of the nozzle that is coaxial about the inner cylinder from a nozzle midpoint to a location at the output port, where the inner cylinder concludes and the accelerant (nitrous oxide, or N.sub.2O) has a high velocity under the influence of the high pressure from the accelerant supply and begins to mix with the air/fuel mixture. The combined streams are deflected by an angled throat of the output port into the engine's intake manifold.

U.S. Pat. No. 5,669,776 discloses a nozzle in which the two passageways extend from respective intake ports but remain separate and spaced from each other until arriving at respective entrances to the mixing cavity of the output port, where the high pressure jet of accelerant is emitted at 90 .degree. to the low pressure jet of air/fuel mixture, where mixing occurs as the combined streams are expressed into the engine's intake manifold.

In another reference, U.S. Pat. No. 5,743,241 sets forth a perimeter frame or plate surrounding a passage into the engine's intake manifold and is situated between the manifold and primary air/fuel source, a carburetor; conduits of fuel and oxidizer or accelerant extend through the frame's perimeter walls and traverse the interior cavity of the frame to respective output or discharge ports adjacent to each other. The high-velocity jet of oxidizer from its respective discharge port is aimed at the manifold so as to pass through the stream of fuel from its respective discharge port, serving to atomize the fuel and also urge an increased amount of air/fuel mixture from the carburetor into the passage.

It is desired to provide an apparatus for atomized spray of a liquid or gas for various purposes.

It is more particularly desired to provide a mechanism for atomized spray of a secondary fuel or accelerant for homogenized admixture thereof with a primary fuel and air for an internal combustion engine.

It is also desired to provide an apparatus that substantially improves the efficiency of accelerant atomized injection into an internal combustion engine for enhanced combustion efficiency or detonation control.

It is further desired to provide a modular accelerant atomized injection apparatus that is retrofittable into existing engines.

It is additionally desired to provide a durable modular accelerant atomized injection apparatus that is movable from engine to engine.

SUMMARY OF THE INVENTION

The present invention, briefly, is an apparatus for atomized spraying of a liquid for admixture thereof with a spray of non-atomized fluid or a mixture thereof with air or other gas. The present invention utilizes an optimized relative spray angle between the atomized spray and a non-atomized spray for a resultant atomized admixture thereof, at each gate or port location (hereinafter termed "gate").

In accordance with one aspect of the present invention, an embodiment of injection gate for atomized spray of a high pressure liquid, is an exit port from an exit passageway in fluid communication with a source of the liquid and having a floor and a ceiling and opens onto a space, the floor being planar and terminating at an edge at the space, and the passageway concluding in a deflection surface beginning distally of the floor edge and continuing from the ceiling about a continuous spherically concave shape with an angular distance of less than 90° in a direction transverse of the passageway, the deflection surface with the floor edge defining an opening into the space having a semi-cylindrical cross-section, whereby the flow of liquid is deflected an angular distance less than 90° through the opening into the space whereby the liquid atomizes into a spray plume having a distinct direction.

In a particular application, the present invention includes an embodiment of a fuel injection apparatus that provides for high pressure, high velocity injection of a secondary fuel in atomized form in addition to the primary fuel or fuel/air mixture, for admixture with air into the manifold plenum of, for example, a high performance internal combustion engine. Such an apparatus is especially beneficial for enhancing horsepower levels for improved performance of vehicles for drag racing or other off-road scenarios, especially when the secondary fuel is nitrous oxide ($N_2O$).

Briefly, one primary aspect of the present invention is providing an atomization injection of a secondary high velocity fuel, termed accelerant hereinbelow, into a throttle bore of an intake for one or more cylinders of an internal combustion engine, that maximizes the expression of both the secondary and primary fuels into a particular cylinder or cylinders by aiming the accelerant downwardly into the throat of the bore. Closely related thereto is providing such aimed injection from a ring of points elevated above the bore entrance comprising at least three points and directed sharply downwardly to converge toward a center of the throttle bore, such that the accelerant plumes can be said to form a halo of admixture spray extending into the bore; the atomized accelerant spray induces primary fuel/air mixture to achieve higher velocity into the bore as the atomized spray becomes admixed therewith. This gate arrangement and halo can also be easily adapted for use in manufacturing processes where admixture of a high velocity fluid with another fluid is desired.

The apparatus includes a modular injection billet plate assembly with captive internal runners and laterals with precision edge gate discharge gates for injection of the primary fuel or fuel/air mixture and the accelerant, into the throttle bore and/or manifold plenum of an internal combustion engine. The assembly is adapted to be interposed between a carburetor and the bore or manifold of the engine, and preferably removable therefrom if desired, and is modular such that a plurality of injection plates can be simultaneously so interposed to provide multiple stages of injection upon actuation by a control during operation of the engine at speed, to provide greatly enhanced horsepower without requiring other modifications to the engine.

In an internal combustion engine having four cylinders, example, an injection region is associated with each engine bore, so there are four injection regions. For each injection region, the accelerant runners extend around the periphery of an aperture, preferably cylindrical, through the injection plate above a respective cylinder's bore, and a plurality of small-dimensioned machined gates or very small diameter drilled gates are defined in communication with the aperture spaced around the aperture in a manner to provide balanced distribution of the accelerant about the periphery of each plate aperture of an injection plate. Likewise, fuel or fuel/air runners extend around the periphery of the cylindrical aperture through the injection plate that coincides with a respective throttle bore, with one or more fuel gates arranged in groups that are associated with one or more accelerant gates. The accelerant will be injected as a liquid at high velocity that immediately transitions to an atomized form as a spray directed radially inwardly and at a sharp angle substantially downwardly toward the cylinder's bore from the plurality of gates, defining the halo effect described hereinabove.

Where the primary fuel or fuel/air mixture is injected into the aperture from a like plurality of gates from associated runners generally beneath the associated accelerant gate(s), the accelerant will atomize the primary fuel of the fuel/air mixture, defining a spray plume directed distinctly downwardly toward and directly into the throat of the intake bore. The one or more accelerant gates can also be directed at an angle to the peripheral direction and offset in the peripheral direction from one or more associated fuel or fuel/air gates in peripherally spaced apart groupings for more uniform mixing and atomization and/or to impart a swirling effect for better distribution and atomization. Two or more accelerant gates can be associated with a single fuel or fuel/air gate or two or more fuel or fuel/air gates provided in peripherally spaced apart groupings to also provide increased atomization and more uniform distribution across an open cross-sectional area of the inlet aperture or opening into the intake manifold. It is also possible to have two or more fuel air gates associated with a single accelerant gate in peripherally spaced apart groupings to provide for increased and more uniform mixing. In these arrangements, the accelerant and fuel or fuel/air gates in each of the peripherally spaced apart groupings are not necessarily directly stacked over one another, although they could be, and the discharges from the accelerant gates are directed at the fuel or fuel/air gate discharge flow to provide for uniform mixing and atomization.

The runners for the accelerant are horizontal, the accelerant is under high pressure, such as from 700 to above 1000 psi, and at each gate is a deflection surface that deflects the high velocity accelerant at that sharp angle, or the gate is at an angle equivalent to such a deflection surface, generating the plume. The high velocity plume induces and enhances the downwardly flow of air from the carburetor, and also atomizes the injected low velocity fuel or fuel/air mixture entering the aperture beneath the accelerant gate(s) into an evenly dispersed homogenized blend, to create a halo.

In one embodiment, a top plate is associated with providing accelerant and includes runners along its bottom surface defining accelerant channels in fluid communication with an inlet port. A bottom plate is associated with providing the primary fuel/air mixture and includes runners along its top surface defining fuel/air channels similarly in fluid communication with an inlet port. An intermediate plate is secured between the top and bottom plates completing closure of all runner channels and their balancing laterals and forming passageways, and O-rings may surround the peripheries of the runner areas of the top and bottom plates. Each such arrangement defines an assembly that can be interposed between a carburetor and a manifold without modification of either, and can also be later removed therefrom and again replaced thereinto or assembled into another engine. Additionally, it is also part of the present invention to provide a plurality of such assemblies disposed in a stack between the carburetor and the manifold for multi-stage accelerant injection or accelerant/fuel/air admixture injection, through the use of sensors for controlling the operation of the stages.

In another embodiment, a single precision modular plate has a top surface providing runners and laterals for the accelerant, and a bottom surface providing runners and laterals for the fuel/air mixture, and is assembled between essentially flat plates that close off the runners and laterals; this embodiment would be especially useful for retrofit capabilities on existing engines. An O-ring channel with an O-ring therein may surround each of the runner areas of the top and bottom surfaces. Preferably, the top flat plate defines a deflection surface at each accelerant gate of an injection region, to direct the high velocity accelerant radially inwardly and at a sharp angle distinctly downwardly into the throat of a cylinder bore. The bottom flat plate could be machined to define a shallow short channel to comprise a gate, or drilled to define a gate, for the fuel/air mixture which needs no deflection surface. With this embodiment as well, it is contemplated to provide a stack of such subassemblies for multi-stage injection. Additionally, ledges are formed by at least a portion of the plate that extends below each of the accelerant gates so that the associated lower pressure fuel or fuel/air gates in each grouping are shielded from a direct downward flow of the accelerant, which could impede fuel flow.

With the present invention, greatly enhanced performance is achieved for high performance internal combustion engines that otherwise are of conventional design. While use of accelerants for enhanced high performance is known, the present invention optimizes directing and balancing the atomized high velocity flow of accelerant in a halo plume effect directly into the respective throttle bores of a multi-cylinder engine, eliminating backsplashing against internal surfaces of the manifold plenum and consequent backsplash which would otherwise lessen efficiency. An additional advantage is that the injection billet becomes a heat sink wherein the temperature is greatly lowered by the atomization process to such a degree that it drains heat from the engine to assist in cooling thereof.

The present invention is not restricted to high performance internal combustion engines. The edge gate design of a plurality of circumferentially distributed gates about an opening, or a peripheral array of gate passageways appropriately angled radially inwardly and downwardly, creating the halo plumes of atomized fluid from a high pressure reservoir, can be used in other processes such as in manufacturing where admixtures with other liquids and gases or even fine solid particles, or mixtures thereof, are desired for improved homogenization. The materials from which the injection billets would be made would vary depending on the fluid to be atomized; for example, austenitic- or martensitic-based steel could be used for acid corrosive application. Industrial and commercial applications would include halo injection into air lines, plumbing, hermetically sealed sterile injection for the food service industry and pharmaceutical applications.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE PREFERRED EMBODIMENTS

Figure 1:
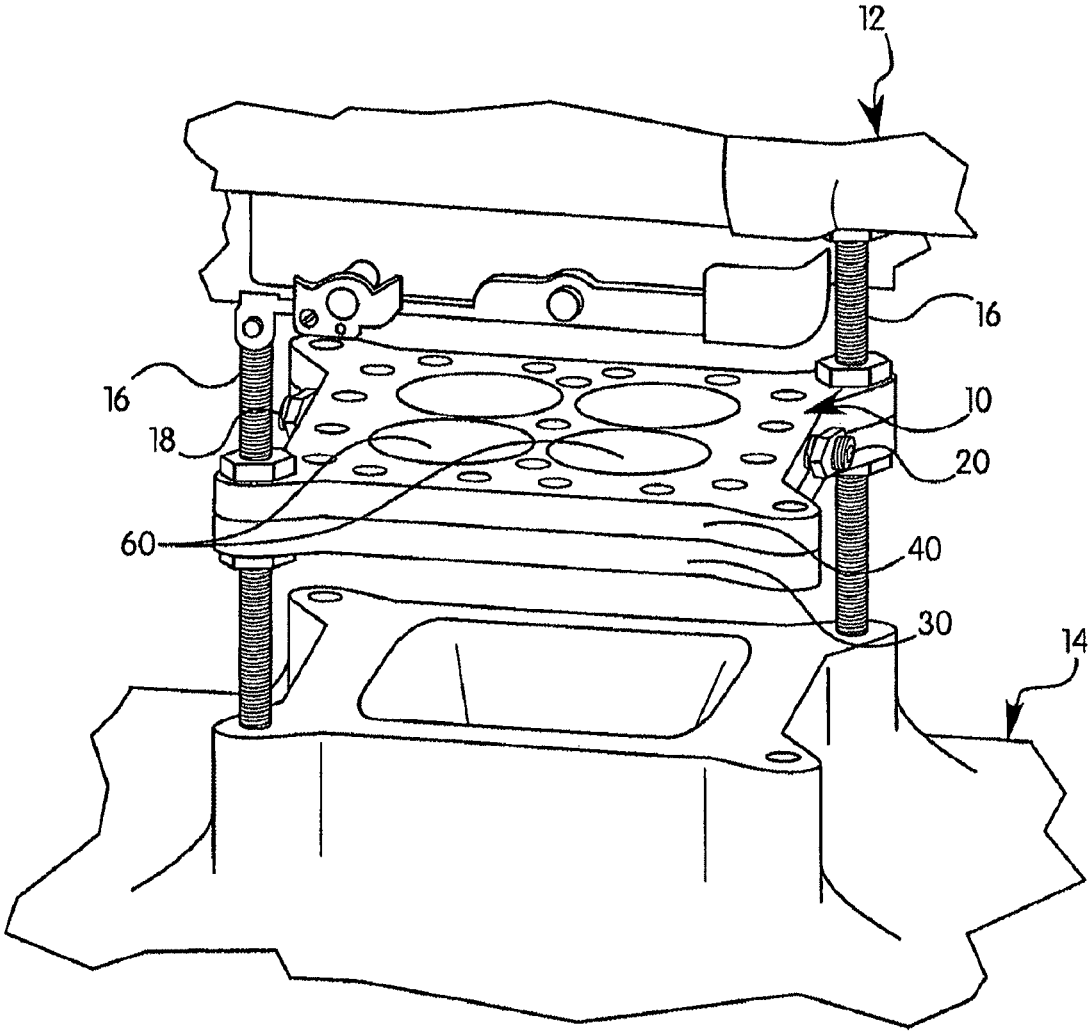
FIG. 1 is an elevation view of a plate assembly of the present invention interposed between a conventional carburetor and a conventional manifold of an engine for assembly therewith.

In the drawings, like numerals indicate like elements throughout. Certain terminology is used herein for convenience only and is not to be taken as a limitation on the present invention. The terms "gate", edge gate" or "port" all refer to outlet apertures of the runners for the secondary fluid and primary fluid. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention. The reference to a carburetor hereinbelow is for carburetors used with fuel injection apparatus which deliver only air.

In FIG. 1, a representative plate assembly 10 of the present invention is positioned between a carburetor 12 (above) and an engine manifold 14 (below) to be fixed in place by an array of bolts 16, which demonstrates the modular nature of the inventive plate assembly. Plate assembly 10 is an injection billet that includes inlet ports, in which injection fittings 18,20 are disposed, for a primary fluid such as a primary fuel or fuel/air mixture, and for a secondary fluid such as an accelerant, injectable into the air flowing from the carburetor through the injection billet to the manifold plenum. The primary fuel may be gasoline, propane, diesel or kerosene, for example, and may also be alcohol, methanol, nitromethane, or nitrous oxide, and may be mixed with air. The secondary fluid may be an accelerant such as alcohol, methanol, nitromethane, oxygen or nitrous oxide, for example, or could even be water for detonation control. For convenience, and without limitation, the secondary fuel will hereinafter be referred to as "accelerant", and the primary fuel will also hereinafter be referred to as "fuel/air mixture" hereinafter, when it refers to fuel being injected by the injection billet.

Figure 2:
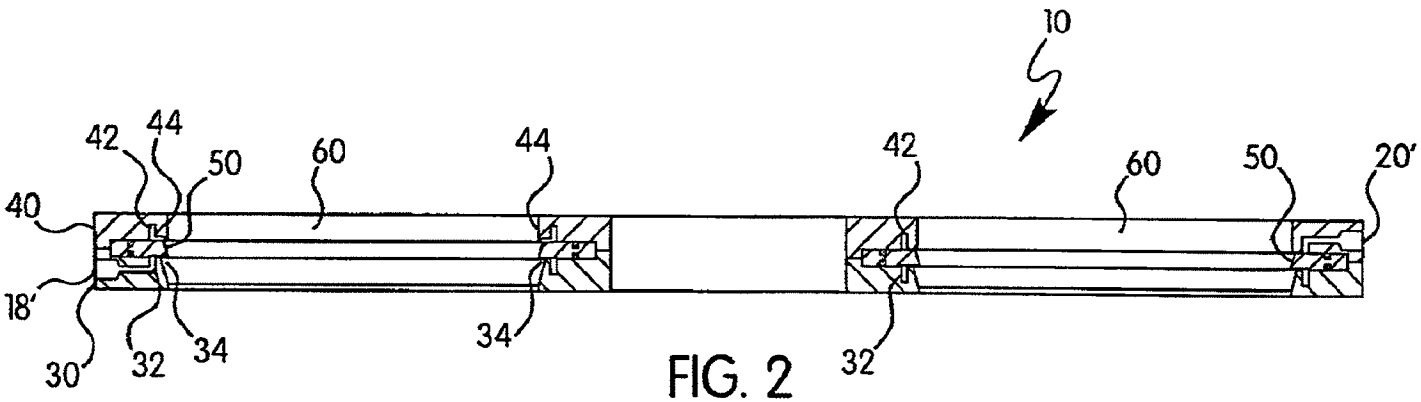
FIG. 2 is a cross-sectional representation of the plate assembly of FIG. 1 showing two main apertures associated with two bores of the engine, in which four gates for atomized fluid are positioned above four corresponding gates for fuel/air mixture for introduction into the manifold.
Figure 3:
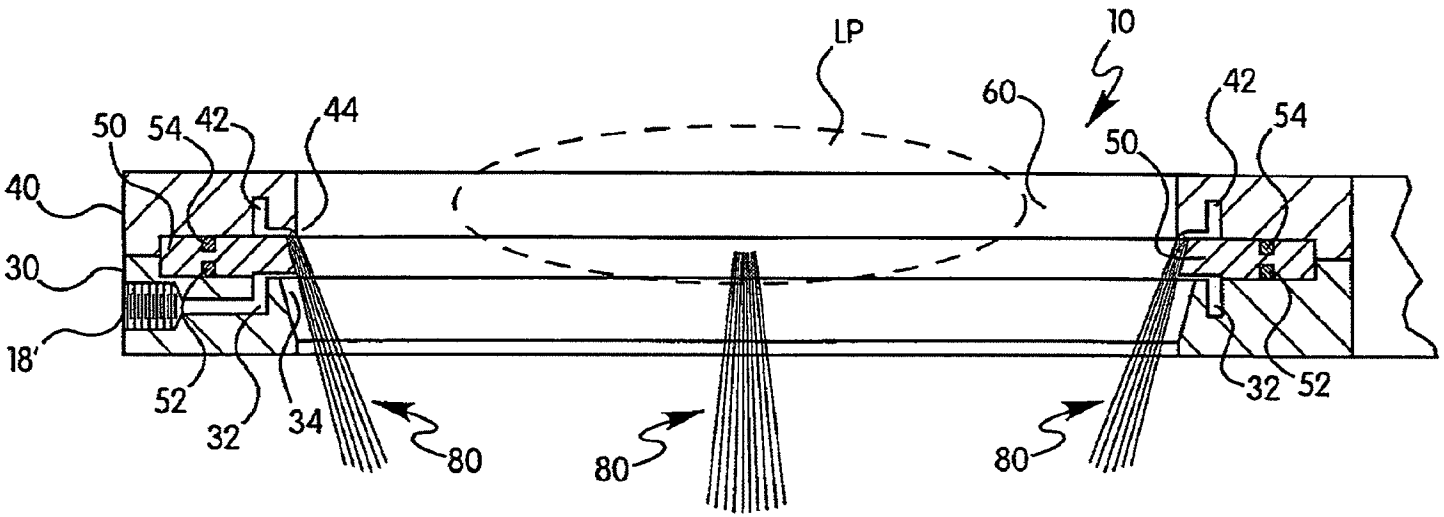
FIG. 3 is an enlarged view of one of the main apertures of FIG. 2 showing representative plumes of atomized fluid and the admixture with the fuel/air mixture directed into the manifold toward a mouth of one bore of the engine.

FIGS. 2 and 3 illustrate that injection billet 10 is an assembly of plates 30,40,50 that are, preferably, precision machined substrates of aluminum but may also be precision investment castings or precision molded components, with burr-free edges. Lower plate 30 with inlet port 18' is associated with the fuel/air mixture and is positioned adjacent the top of the plenum of manifold 14, while upper plate 40 with inlet port 20' is associated with the accelerant and is positioned immediately beneath the carburetor 12. A tuning plate 50 is contained within and between the lower and upper plates 30,40 providing closure to runners 32,42 of both plates and with precisely formed smooth, optionally milled-finished, surfaces adjacent multiple outlet ports or gates 34,44 of the runners for the fuel/air mixture from lower plate 30 and the accelerant from upper plate 40, all of which open onto the intake opening of the manifold 14.

Runners 32,42 circumscribe each main aperture 60 (hereinafter, "throttle bore") and are in fluid communication with respective lateral fuel transfer passages at respective inlets 18',20'; the runners preferably are rectangular for ease in precision manufacturing of the upper and lower plates. O-rings 52,54 are positioned and compressed between the tuning plate and each of the lower and upper plates surrounding the arrays of runners and gates for assured sealing, although substantial sealing between the smooth plate surfaces also is attained by initial increments of liquid entering and filling the incremental gaps of the plate interfaces, which serves to prevent especially the accelerant from changing to a gaseous state. Alternatively, sealing can be attained based on the surface finish of the plates, and the O-rings can be omitted. Preferably, the plates of the injection billet are fixedly secured together such as by an array of screws or bolts countersunk into at least the outermost surfaces of the upper and lower plates.

With reference now to FIG. 3, an array of multiple gate pairs 34,44 is seen that are associated with one bore of the engine and are peripherally situated around a throttle bore 60 therefor and open thereonto to equalize the accelerant and fuel/air mixture distribution radially therearound, with accelerant and fuel/air fluids depicted exiting therefrom toward the mouth of the throttle bore (FIG. 1). While the fuel/air mixture exits in a horizontal direction from gates 34, the accelerant, such as nitrous oxide, is directed by the geometry of gates 44 distinctly downwardly and at a small but critical discharge angle radially inwardly, which discharge angle is discussed later below. The fuel of the fuel/air mixture is initially in the form of a small stream, entering under a pressure of generally about 5 to 9 psi in a horizontal direction into the throttle bore 60 between the carburetor and the manifold associated with the one bore, which has a lower ambient pressure generated by the engine and the injection billet, such as about 0 to negative 15 psi and indicated as area LP adjacent the carburetor (FIG. 1); an injection billet would typically be utilized with an engine having a wide open throttle.

The accelerant is initially in the form of high velocity liquid from a tank maintaining a pressure of generally about 700 to 1100 psi but usually about 800 to 1000 psi, and immediately atomizes upon exiting the gates 44 because of the low pressure within the throttle bore 60. The accelerant is directed at a selected discharge angle intersecting the fuel stream and causes atomization thereof as a result of shearing of the stream by the high velocity atomized microdrops of accelerant. The resultant spray from each gate pair 34,44 is shown as a distinct plume 80 of the admixture entering the bore mouth in a controlled dispersal pattern, in an evenly dispersed homogenized blend, that balances the pressure beneath the carburetor and complements and enhances the velocity of the carburetor airflow without inducing turbulence.

Figure 4:
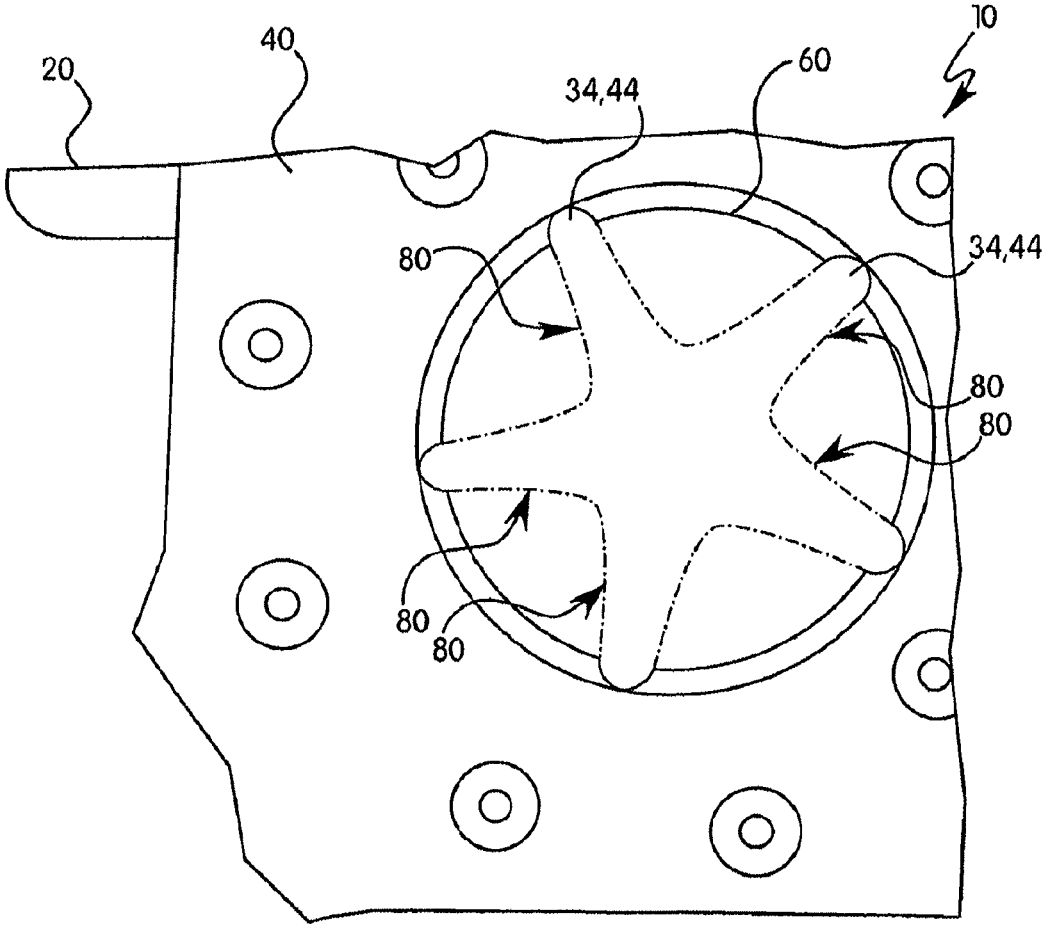
FIG. 4 is a photograph from above of atomized fluid and fuel/air admixture of the main aperture of FIG. 3 illustrating the halo effect of the atomized plumes, but for a plate assembly having five gates around the aperture.

A drawing of the inventive injection billet 10 in operation, from above, is provided as FIG. 4. An array of five gate pairs 34,44 is shown peripherally disposed about throttle bore 60 of the billet associated with one bore of a four-cylinder engine. Spray plumes 80 are seen exiting from each gate pair 34,44 and contain both the accelerant (from gate 44) and the fuel/air mixture (from gate 34), defining a halo effect uniquely obtained by the present invention, which is a signature indicative of highly efficient atomization of the accelerant/fuel/air admixture, bringing order to the otherwise highly erratic spray pattern of prior art fuel injection systems, greatly improving engine efficiency and substantially increasing the nominal horsepower of the engine.

FIGS. 5 to 8 are enlarged cross-sectional views of the injection billet 10 at one gate pair location, in which various configurations of accelerant gate geometries is shown. Fuel/air runners 32 are designated as F/A, while accelerant runners 42 are designated as $N_2O$. The fuel/air mixture exits its gate 34 generally horizontally through a lateral passageway and at relatively low velocity due to a low reservoir pressure of generally from 5 to 8 psi into a lower ambient pressure within a throttle bore as explained above; the height dimension of the lateral runner portion may be critically controlled by the adjacent surface 38 of tuning plate 50.

While the gate geometry for fuel/air gates 34 is important, the gate geometry for accelerant gates 44 is critical to optimum performance of the injection billet of the present invention. The surface 36 of lower plate 30 adjacent to the main aperture is beveled at an angle $\gamma$ of about 15° from vertical which serves to create an initial expansion area of limited volume, of low pressure adjacent to the fuel/air gate 34 in which the fuel stream begins to disperse into very small droplets. It is seen that the angled surfaces of the tuning plate 50 and the lower plate 30 adjacent the throttle bore define reversion lips that minimize or even eliminate any fuel throwback or air flow reversion.

Figure 5:
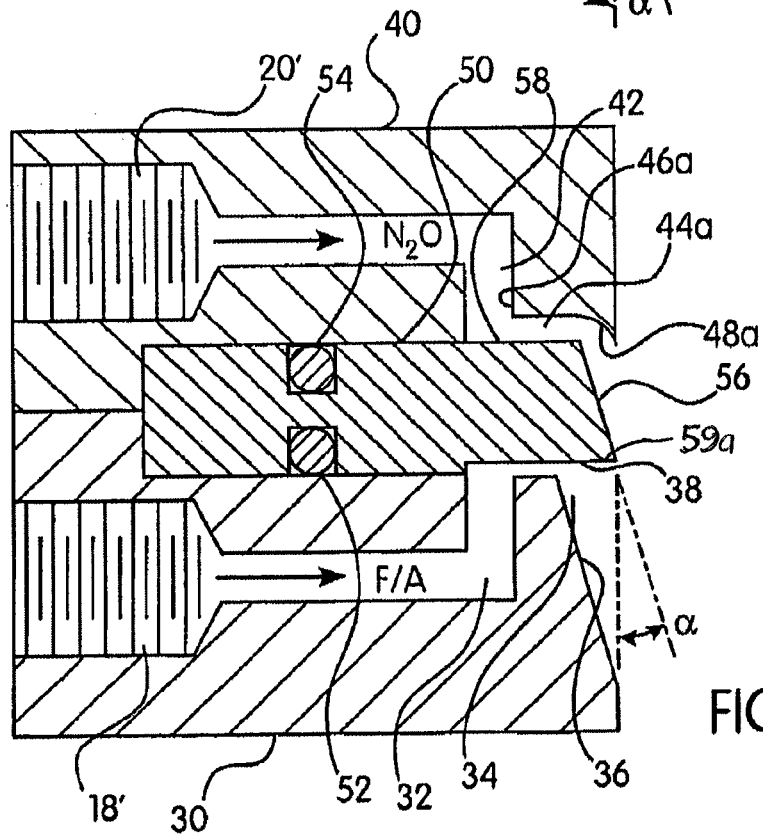

In FIG. 5, firstly, O-rings 52,54 are preferably seated in grooves of tuning plate 50. Surface 56 of tuning plate 50 adjacent to the throttle bore cooperates with the direction of atomizing spray of accelerant from gate 44 controlled by the gate geometry of gate 44; surface 56 is beveled at an angle α between about 5° and 25°, more preferably between 10° and 20°, and most preferably at an angle of 15°. While the angle of surface 56 is preferred for each of the geometries of FIGS. 5 to 8, the actual accelerant gate geometry differs in the Figures. The surface 56 forms a lip 59*a* that extends over the fuel/air gate 34, protecting it from a direct shearing flow of accelerant from the accelerant gate 44, which could impede fuel flow, and also acts as an anti-reversion device to suppress or prevent bounce-back flow from the intake manifold. In FIG. 5, gate 44*a* includes a horizontal lateral passageway extending from the runner to the gate, preferably having a semicylindrical cross-section extending along the horizontal top surface portion 58 of tuning plate 50; the gate concludes in a curved deflection surface portion 48*a* of relatively small radius about an angular distance of between about 75° to 90°, such as about 85°. The resultant atomized spray of accelerant would be directed along tuning plate surface 56 to result in a midline direction spray angle of just over 15° (see FIG. 3).

Figure 6:
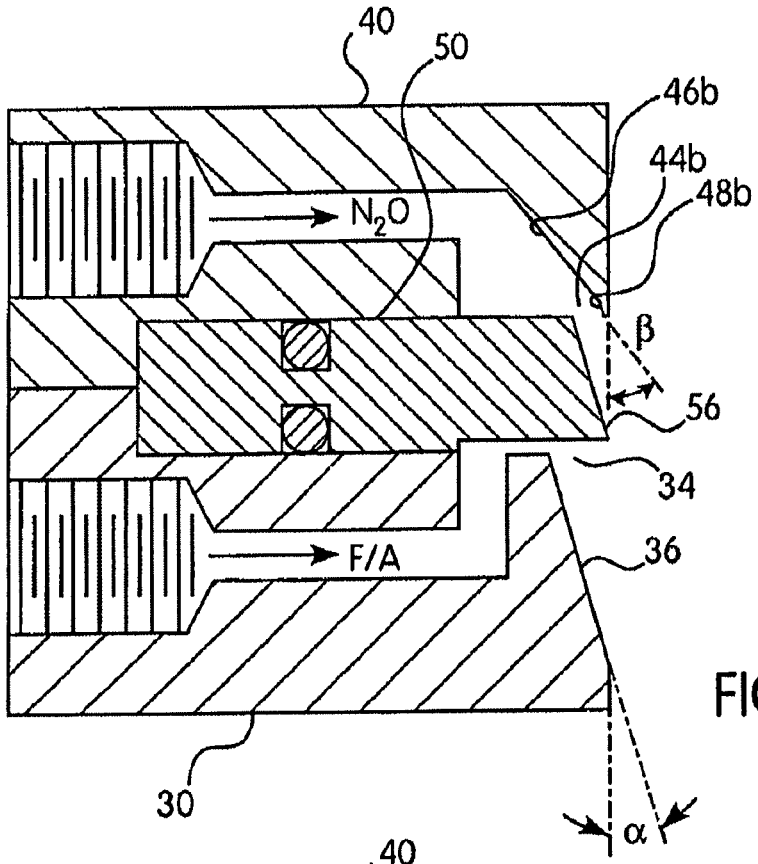
FIGS. 5 to 8 are enlarged, simplified cross-sectional representations of a portion of the plate assembly of FIGS. 1 to 4 showing upper and lower plates sandwiching the tuning plate at a gate pair location, illustrating runners for both secondary (upper) and primary (lower) fluids with respective inlet ports therefor, o-ring arrangements, and also showing various geometrical configurations of the secondary fluid gate.

The accelerant gate geometry of gate 44*b* in FIG. 6 provides a deflection surface 46*b* that is distinctly chamfered at an angle between horizontal and vertical and may, for example, define an angle from vertical of β of between 8° and 25°, and preferably between about 12° and 18°, and concluding in a spherical deflection surface portion 48*b* of limited angular distance. FIG. 6 also shows the 0-rings 52,54 seated in grooves of tuning plate 50. Also, the lower plate 30 has a surface 36 preferably beveled at an angle from vertical of γ which may be quite similar to angle α (FIG. 5) and be from 5 to 25°, more preferably from 10° to 20° and most preferably about 15°, the effect of which is to provide a lower pressure region of limited volume for the fuel stream exiting from gate 34 to begin the formation of very small droplets of fuel just prior to being atomized by the atomized accelerant spray plume. Additionally, and beneficially, the angle reveals a lip formed by the inwardly jutting bottom portion of tuning plate 50 that serves to prevent backsplash of fuel and inhibit air reversion upwardly from the manifold.

Figure 7:
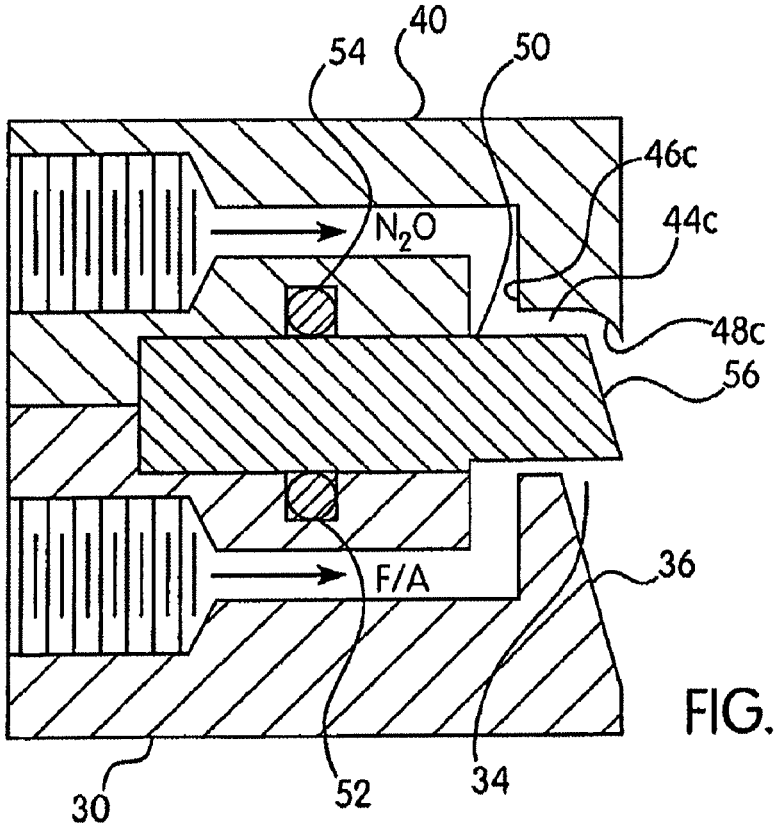

The accelerant gate geometry of gate 44*c* in FIG. 7 provides a lateral passageway 46*c* that is horizontal, similar to that of FIG. 5. Curved deflection surface portion 48*c* is curved an angular distance almost the same as curved surface portion 48*a* (about 85°) but is located slightly closer to the tuning plate. The O-rings 52, 54 are seated in grooves defined in the surfaces of lower and upper plates 30,40, rather than in the surfaces of tuning plate 50.

Figure 8:
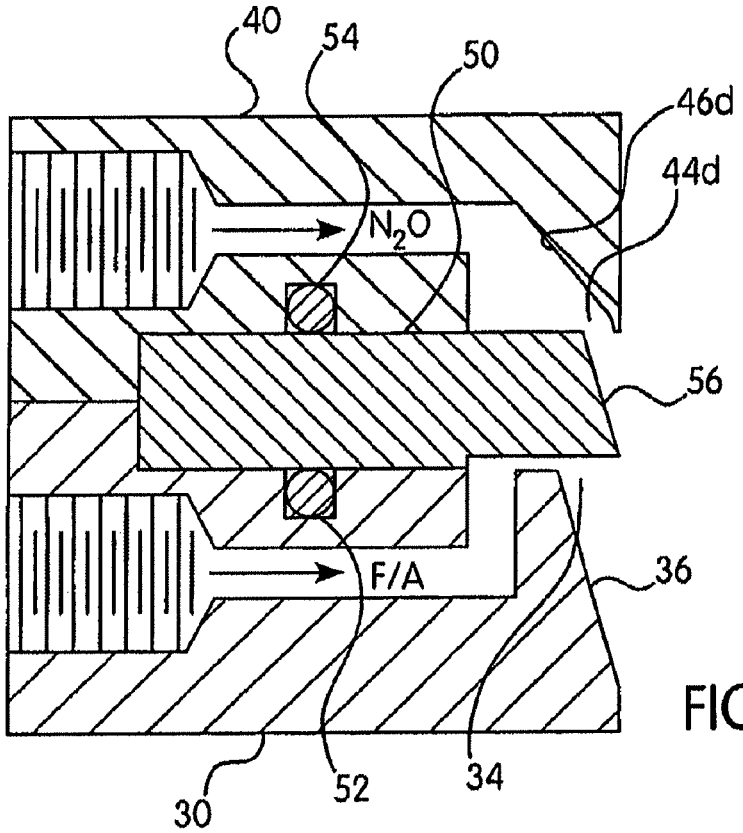

In FIG. 8, gate 44*d* has a lateral passageway 46*d* that is angled similarly to lateral passageway 46*b*, and the O-rings are seated in grooves defined in the surfaces of lower and upper plates 30,40, rather than in the tuning plate 50. Otherwise, the gate geometry matches that of FIG. 7.

It is clear, of course, that the angles of the surfaces may be modified in order to achieve particular results, and to accommodate other factors such as variations in particular high pressure of the available accelerant tank or in the fuel/air reservoir, or the choices of actual accelerant used or actual primary fuel used, or the total number of gates associated with the runners, or in the design level of vacuum drawn by the engine.

Figure 9:
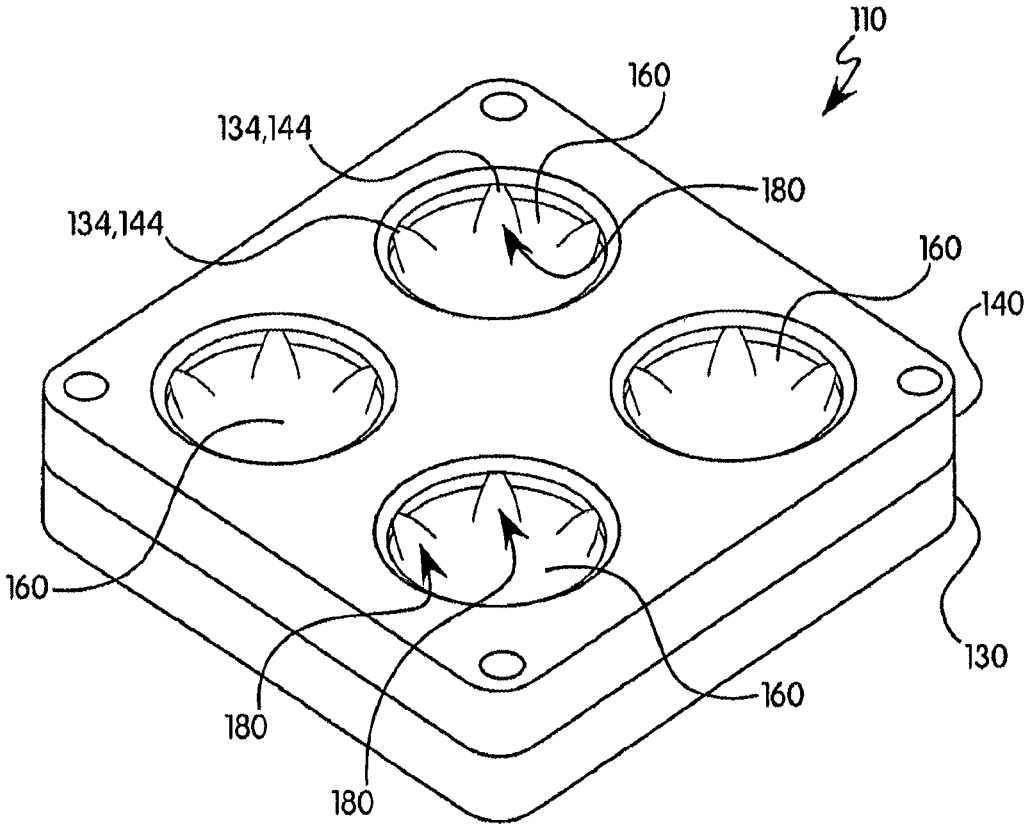
FIG. 9 is an isometric view of an embodiment of plate assembly of the present invention having six gates per main aperture, for a four-bore engine, and showing representative atomized accelerant/fuel/air admixture plumes.

In FIG. 9, another embodiment of injection billet 110 is indicated, having an upper plate 140 and a lower plate 130, in which each array of gate pairs 134,144 includes six such pairs about each throttle bore 160. Spray plumes 180 indicate the location of each gate pair. Such a six-gate pair array would be used such as for a "4500" Holley plate. A five-gate pair array such as that shown in FIG. 4 would be used for a "4150" Holley plate.

Figure 10:
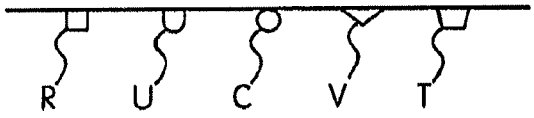
FIG. 10 is a representation of various gate geometries of the present invention, each a view of the discharge opening of a gate of the type shown in the enlarged cross-sectional gate view of FIG. 3.

FIG. 10 illustrates cross-sectional configurations of various runner geometries: rectangular (preferred) at R; U-shaped at U; circular at C; V-shaped at V; and trapezoidal at T. Preferably, for use in the injection billet of the present invention, the fuel/air gate geometry would also be rectangular, with a width of 0.0625 in and a height of 0.0125 in for an injection fitting jet size 53 for a "4500" Holley plate, and with a width of 0.0625 in and a height of 0.0100 in for an injection fitting jet size 47 for a "4150" Holley plate, the height preferably controlled by varying the depth of the groove in the adjacent surface 38 of the tuning plate that forms the top side of the rectangular cross-section of the lateral passageway extending from the runner 32 to each fuel/air gate 34,134 (FIGS. 2, 3 and 5 to 9).

Figure 11:
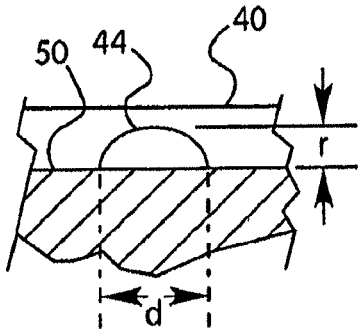
FIG. 11 is a bottom view of an accelerant gate visible outwardly of the throttle bore adjacent surface of the tuning plate, with the tuning plate portion shown in cross-section.

In FIG. 11, the preferred geometry for an accelerant gate 44 is shown, which corresponds generally to the cross-sectional configuration thereof seen in FIGS. 5 and 7. The view is from beneath the tuning plate 50, the bottom line being the edge at the top tuning plate surface 58 as it intersects the angled surface 56. The top line is the edge of the bottom surface of the upper plate 40 as it intersects the inwardly facing surface alongside the throttle bore 60 (see FIG. 3). The semicircular shape seen in FIG. 11 results from gate 44 and its lateral passageway being formed by a ball mill drilling into the bottom surface of upper plate 40 preferably vertically a limited distance, defining a curved surface portion 48*a*,48*c* seen in FIGS. 5 and 7. The preferred dimensions are a curvature having a diameter d of 0.062 in to 0.063 in, and a radius r extending from surface 56 at its edge, of 0.039 in to 0.040 in. These dimensions appear optimum for any size injection jet, from a small jet size 47 to a large jet size such as 110. Further, it is preferred that the edge defined by the intersecting tuning plate surfaces 56,58 has a radius of between about 0.005 in to 0.010 in and more preferably between 0.005 in to 0.007 in.

Figure 12:
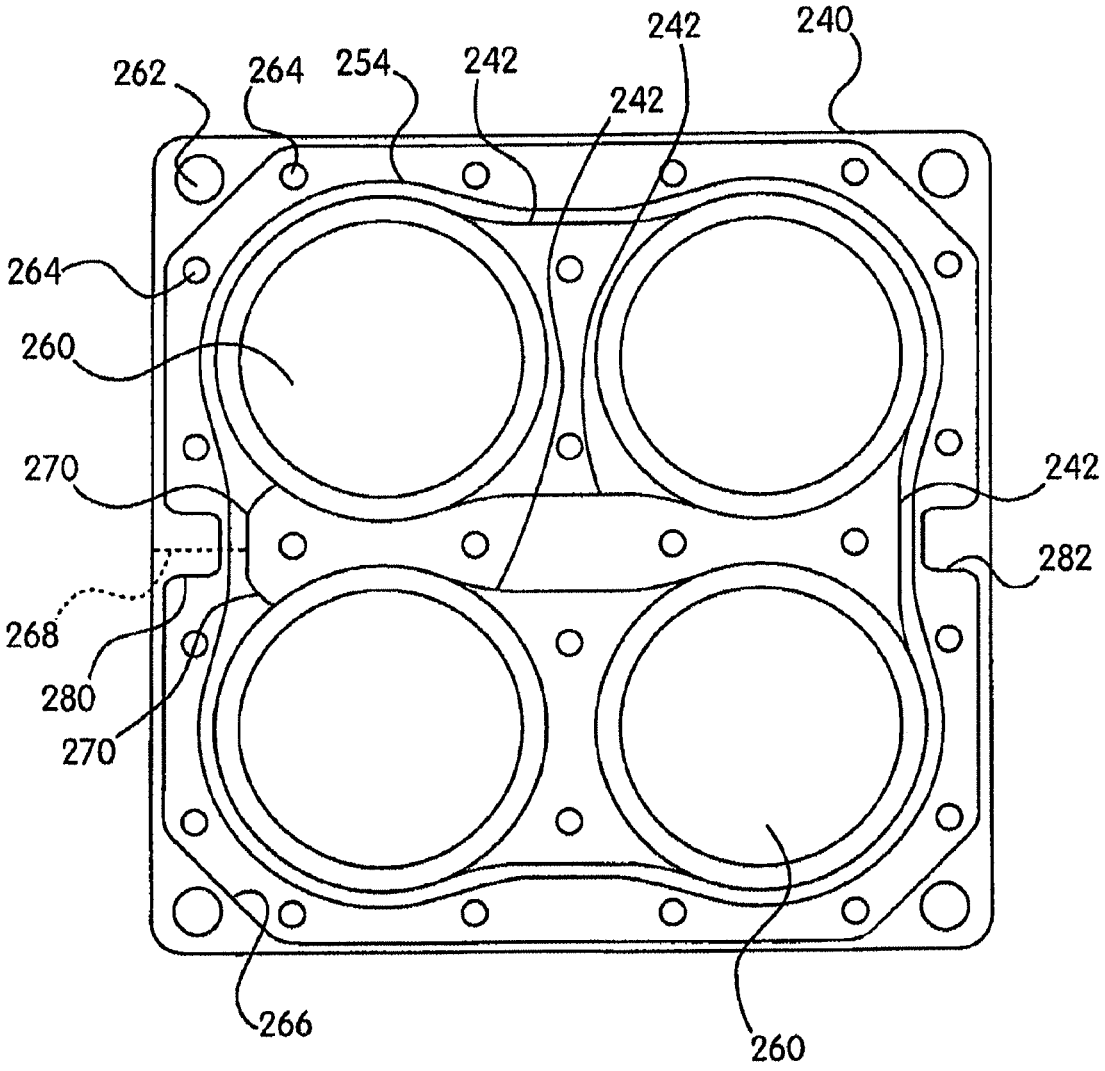
FIG. 12 is a plan view schematic of the interior surface of the upper plate of the injection billet embodiment of FIG. 9, showing the centerlines of the captive runners and the surrounding o-ring.

FIG. 12 is a schematic of an upper plate 240 of a first embodiment of the injection billet of the present invention associated with a four-bore engine and a 4100 Series Holley carburetor profile. The schematic indicates the centerline of the runner circuit 242 routed around four throttle bore apertures 260, and the centerline of the O-ring 254 which may be a groove in plate 240 or may be the location opposed to an O-ring groove of the tuning plate, since the O-ring may be seated in either the upper plate or the tuning plate. Alternatively, the O-rings can be omitted. Four corner bolt holes 262 are shown through which pass the shanks of bolts 16 (see FIG. 1) that affix the injection billet to the carburetor and the manifold. Also shown are an array of screw holes 264 for respective screws (not shown) used to assemble the upper, tuning and lower plates of an injection billet. Preferably, the screw holes are countersunk in the exterior surface of either the upper plate or lower plate. A recess 266 into the interior surface is defined into which the tuning plate will be seated either entirely or partially by also being received into a corresponding recess into the interior surface of the lower plate.

Figure 13:
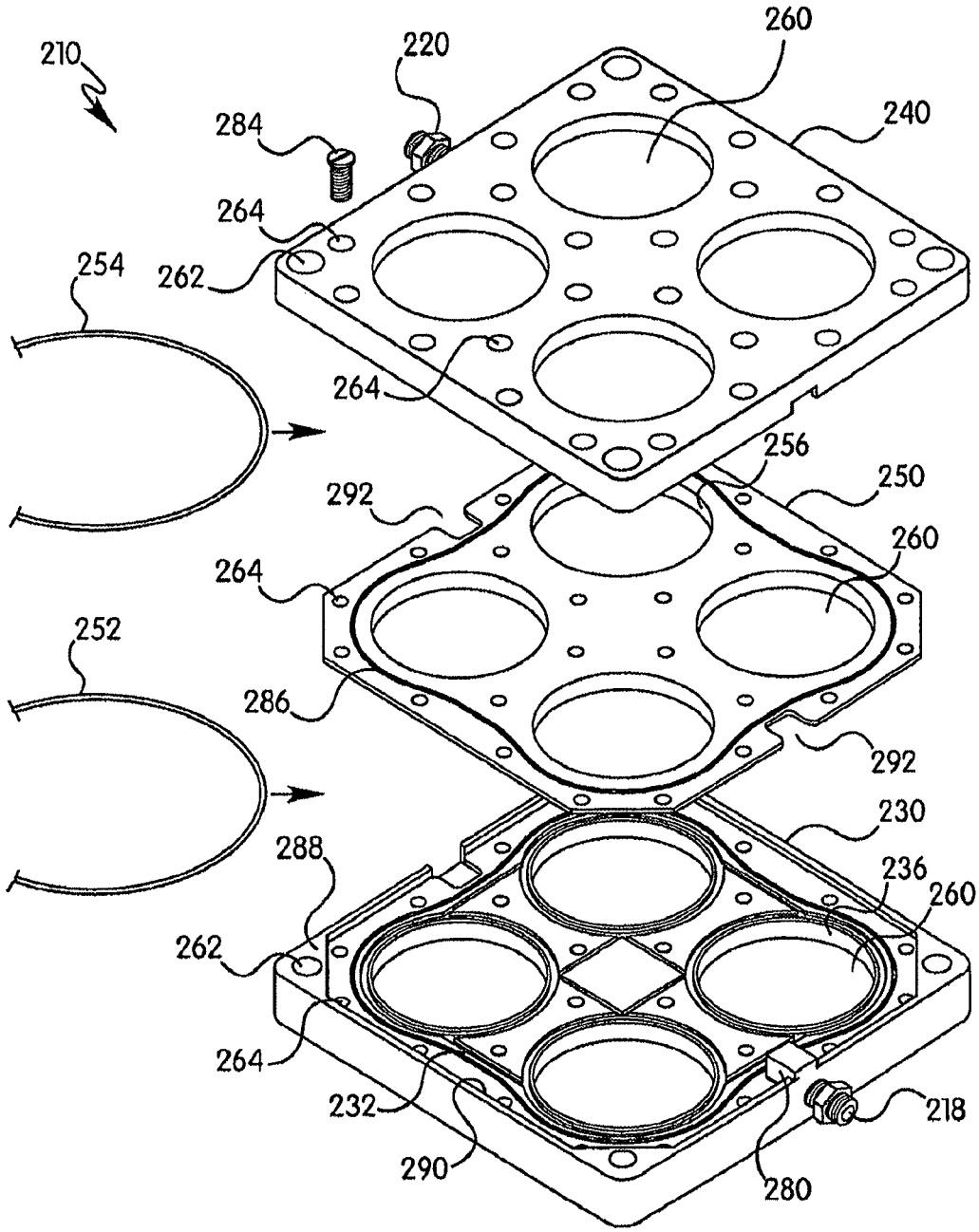
FIG. 13 is an exploded assembly view of the injection billet embodiment of FIG. 12, showing the upper, lower and tuning plates, o-rings, injection jet fittings installed and a representative assembly screw.

Also, with respect to FIG. 12, the centerline for an inlet transfer passage 268 is indicated in phantom extending from the side surface at the inlet port for fitting 220) see FIG. 13), which is joined at a T intersection with a pair of connection runners 270 which in turn preferably join at T intersections to runner 242 at two locations for facilitating quick injection of the accelerant throughout the runner circuit, with minimal "dead" spots. It is seen that the runner circuit extends around the near apertures 260 on both sides to facilitate transmission of accelerant to all gates simultaneously, which begins when accelerant arrives at the center of the far side of the runner circuit to pressurize the runner.

Plate 240 in FIG. 12 is shown to include a boss 280 through which inlet transfer passageway 268 extends, and also to include a notch 282 at the opposite side of plate 240, which correspond respectively to a notch and a boss of the lower plate when the injection billet is assembled; correspondingly, the tuning plate will have notches at both locations for seating the bosses of both plates. This arrangement is advantageous for three reasons: it enables the inlet transfer passageways for both accelerant and fuel/air to be coplanar enabling the injection billet to have minimal height; the bosses and notches serve to additionally mechanically hold the plates securely in their relative positions (reducing stress on the assembly screws); and they serve to assist in precisely positioning the upper, lower and tuning plates with respect to each other to maintain precision of the runner and gate geometry.

Finally, the runner schematic of the upper plate 240 in FIG. 12, may also be identical to the corresponding runner schematic for the lower plate.

Figure 14:
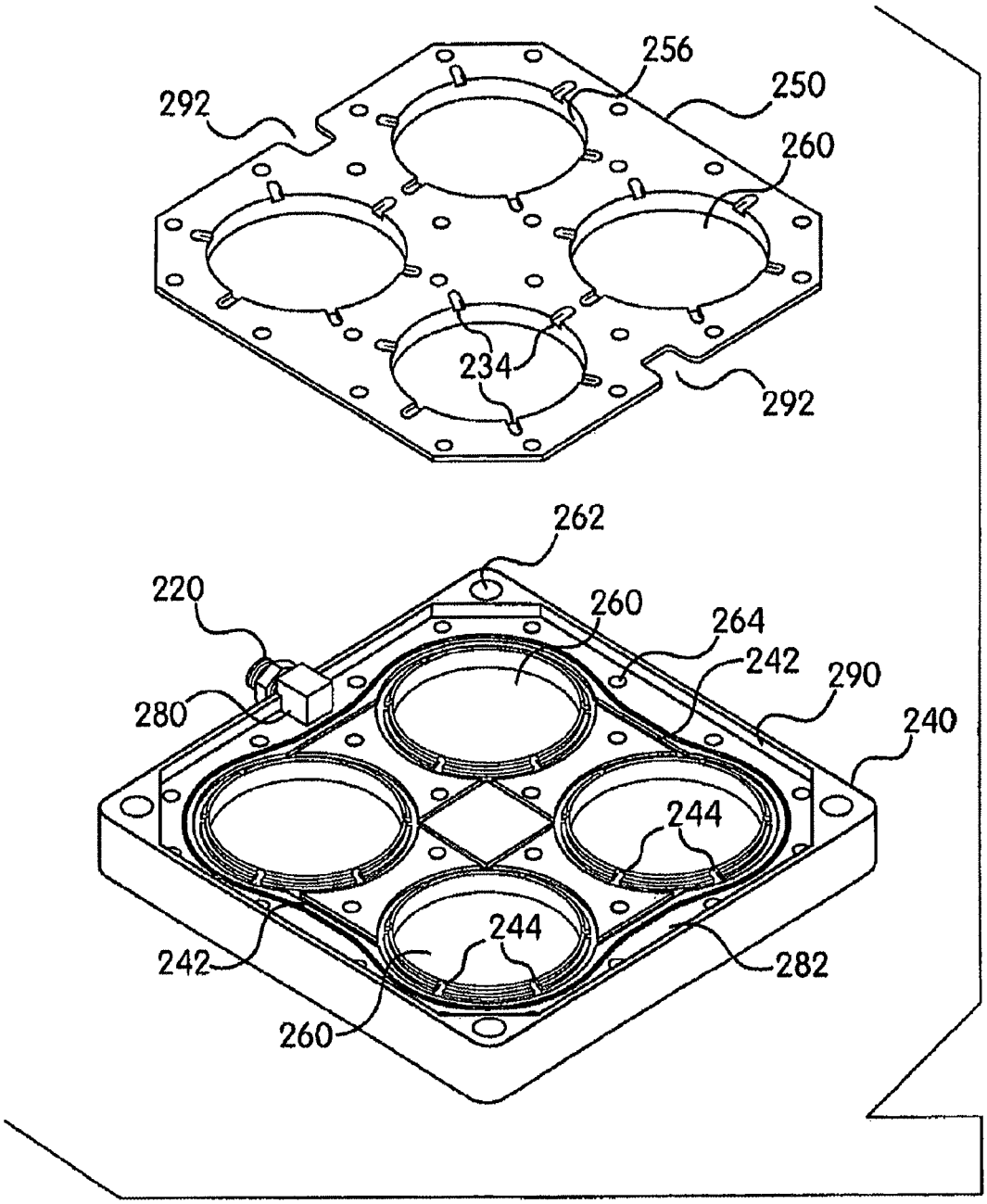
FIG. 14 is an exploded view similar to FIG. 13 from below of the tuning plate and interior surface of the upper plate.
Figure 15:
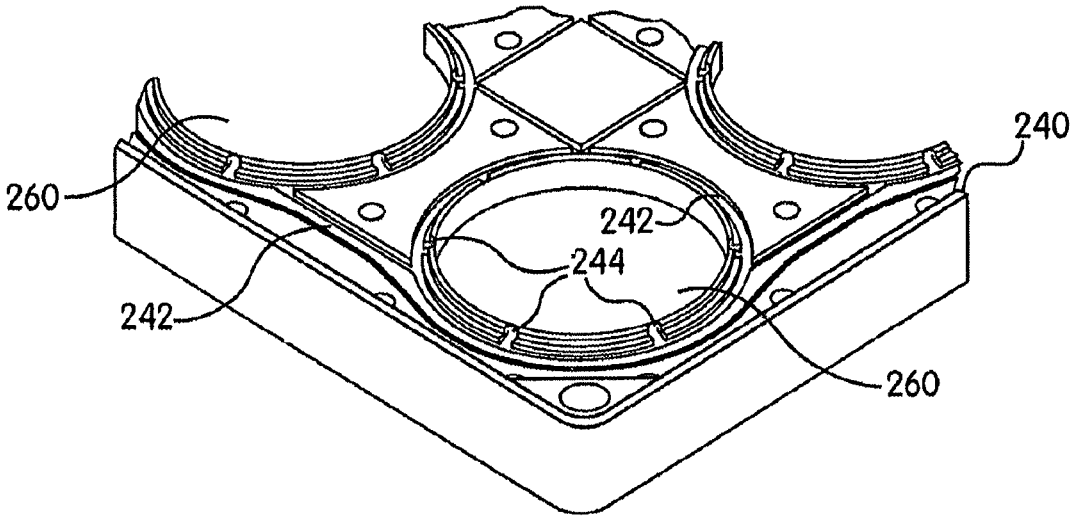
FIG. 15 is an enlarged view of one throttle bore of the upper plate in which are seen six accelerant gates extending from the runner to the throttle bore.

FIGS. 13 to 15 are directed to the structural details of the first embodiment 210 of the inventive injection billet associated with a 4500 Series Holley carburetor profile, for which the runner schematic of FIG. 12 is applicable. In these Figures is shown the upper plate 240, the lower plate 230 and the tuning plate 250 to be nested therebetween, held in assembly by screws 284; O-rings 252,254 and injection jet fittings 218,220 are also shown. In this embodiment, an array of six gate pairs is provided about each throttle bore.

The interior surface of the lower plate 230 is seen in FIG. 13, as is the upper surface of the tuning plate 250. Countersinks for screw holes 264 are provided on the top surface of upper plate 240, although, alternatively, the countersinks could be provided on the bottom surface of lower plate 230 for respective ones of screws 284, but for ease of assembly should all be provided on the same plate. A seat 286 for O-ring 254 is provided on the top surface of tuning plate 250, and a corresponding seat would be provided on its bottom surface, although the O-ring seats could be provided on the interior surfaces of the upper and lower plates 240,230 alternatively, as is seen for the seat for O-ring 252 provided on lower plate 230, or the O-rings and associated grooves could be eliminated. In lower plate 230, surface 236 surrounding throttle bore 260 is also angled radially inwardly, corresponding to FIGS. 5 to 8.

Tuning plate 250 is shown to have chamfered corners, corresponding to angled corner portions 288 of the lower plate 230 that mark the corners of the tuning plate-receiving recess 290 into the lower plate through which extend the bolt holes 262, with a corresponding arrangement provided on the upper plate, as shown in FIG. 14. Further, tuning plate 250 includes notches 292 for the bosses of the upper plate and the lower plate to pass through. In tuning plate 250, surface 256 surrounding throttle bore 260 is angled radially inwardly, corresponding to FIGS. 5 to 8.

FIG. 14 provides a view of the interior surface of the upper plate 240 and the lower surface of the tuning plate 250. Recess 290 for tuning plate 250 is seen on the interior surface of upper plate 240, and also seen are boss 280 at injection jet fitting 220 through which extends transfer passage 268 (FIG. 12), and notch 282 for receipt thereinto of boss 280 of lower plate 230. Halo hex gates 244 are seen provided on the interior surface of upper plate 240 around each throttle bore 260, with each bore having an array of six gates 244, and each of which may have the gate geometry shown in any of FIGS. 5 to 8. On tuning plate 250 are seen shallow precisely dimensioned groove segments defining gates 234 that upon assembly of the injection billet will provide fluid communication between the fuel/air runners 232 of lower plate 230 and the throttle bores 260; also, surface 256 is angled radially inwardly and upwardly in this view.

In FIG. 15, an enlargement of one throttle bore of the interior surface of upper plate 240 clearly shows the six halo hex gates 244 for accelerant. In this Figure, the gate geometry corresponds to that shown in FIG. 6 or 8.

Figure 16:
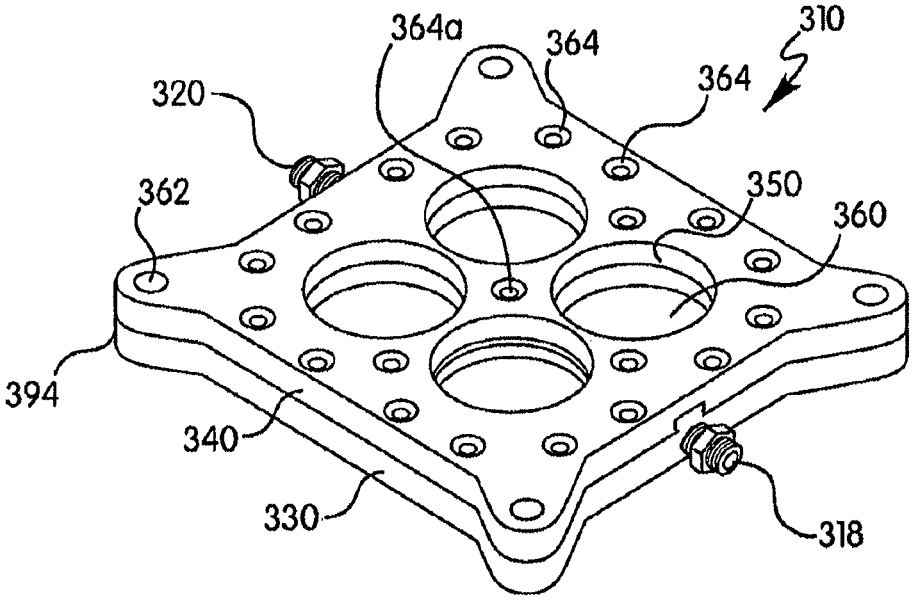
FIG. 16 is an isometric assembly view of a second embodiment of injection billet of the present invention.

FIGS. 16 to 23 are directed to a second embodiment of injection billet 310. Injection billet 310 corresponds to a 4150 Holley plate having a reduced footprint, that is, the throttle bores are more closely spaced, although the bore holes 362 are at locations corresponding to those of injection billet 210 of FIGS. 13 to 15 and are located on ears 394 of the billet. The available area within the array of throttle bores 360 is greatly confined, leaving enough space for only one screw hole 364*a*. Injection jet fittings 318,320 are evident in these Figures. In FIG. 16, tuning plate 350 is seen in throttle bores 360 sandwiched between upper and lower plates 340,330. Additionally, the apertures of the injection billet that coincide with the throttle bores may be flattened along their innermost sides adjacent others of the apertures, better seen in FIGS. 17 and 18, without noticeable effect in performance and efficiency of the injection billet of the present invention.

Figure 17:
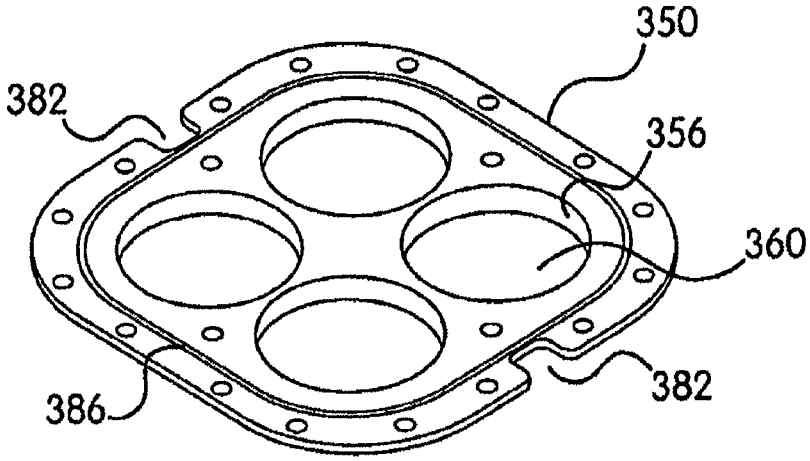
FIGS. 17 and 18 are isometric views from above of the tuning plate and lower plate of the injection billet of FIG. 16.
Figure 18:
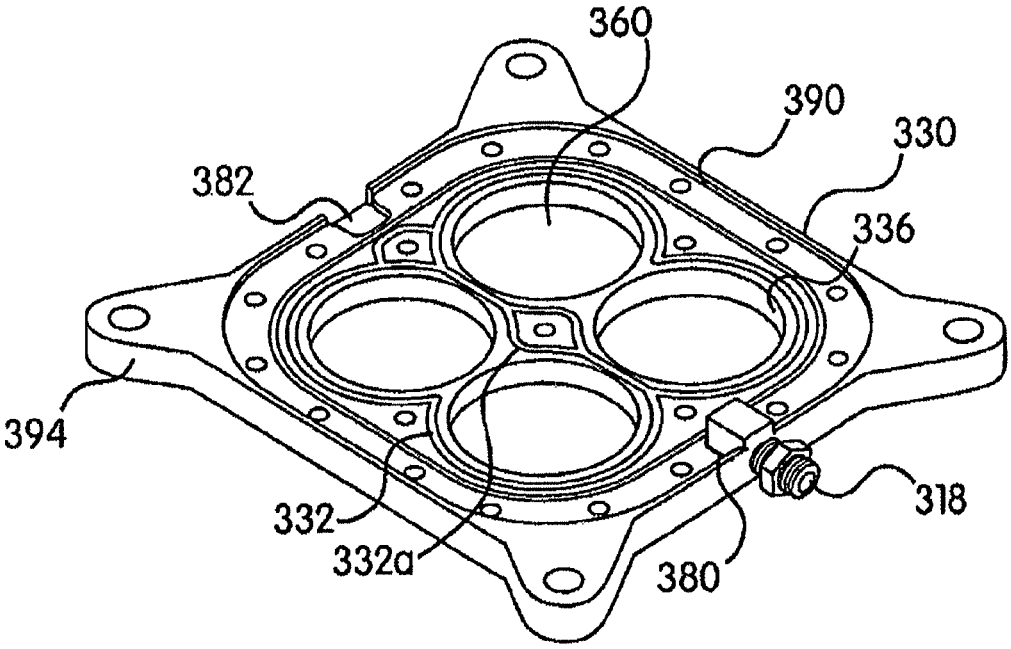

The upper surface 358 of tuning plate 350 appears in FIG. 17, and the interior surface of lower plate 330 appears in FIG. 18. Tuning plate 350 includes notches 392, corresponding to tuning plate 250 in FIGS. 13 and 14; bosses 380 are provided in lower plate 330 and in upper plate 340 (FIG. 20), as well as notches 382 complementing the bosses of the other plate.

Figure 20:
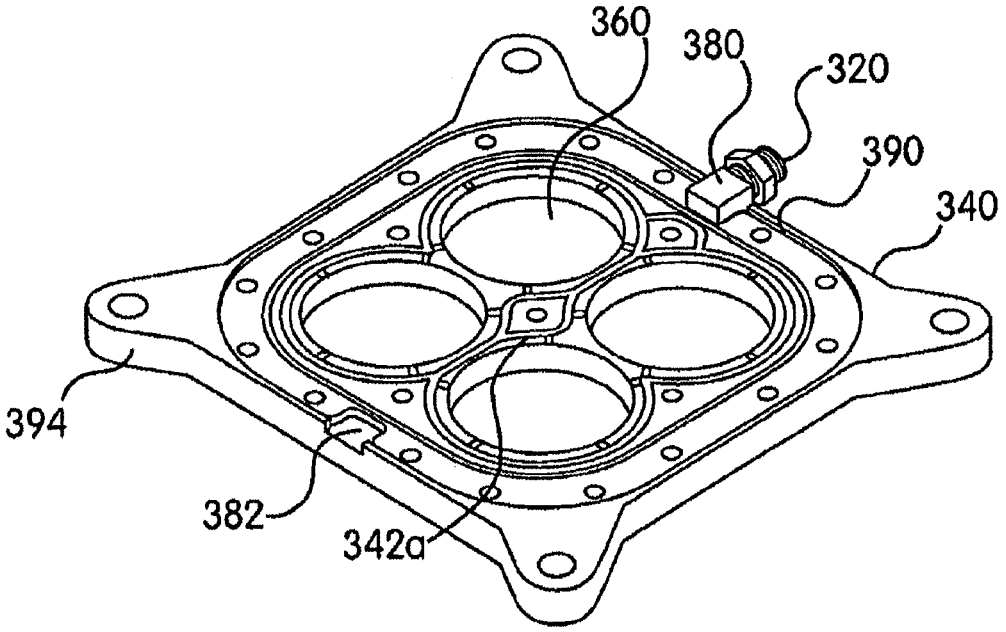

Referring to FIGS. 18 and 20, the runner configuration is modified compared to that of FIGS. 12 to 15, due to the confined area between the throttle bores. A single runner segment 332*a*,342*a* is provided in lower and upper plates 330,340, respectively, between the throttle bore pairs to either side of the inlet injection jet, and the segment bisects throttle bores in one direction diverge around single screw hole 364*a* in the center to reach pairs of gates and reconverge, best seen in FIG. 22, thus supplying accelerant and fuel/air to the gate pairs at the adjacent portions of the arrays.

Figure 19:
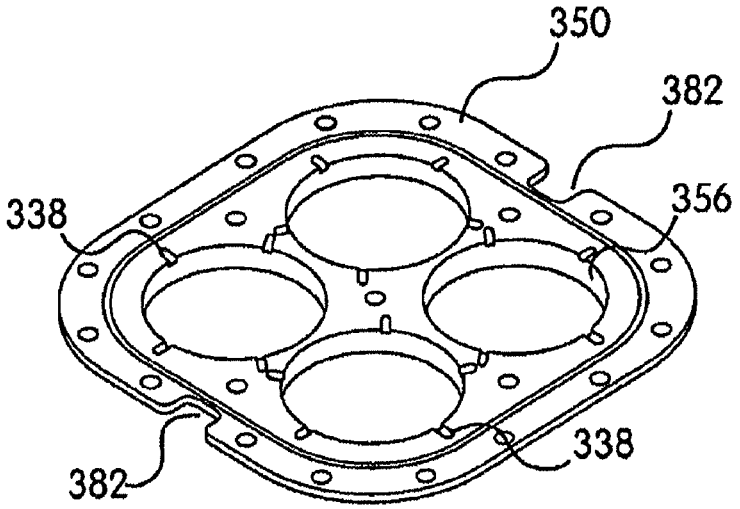
FIGS. 19 and 20 are isometric views from below of the tuning plate and upper plate of the injection billet of FIGS. 16 to 18.
Figure 21:
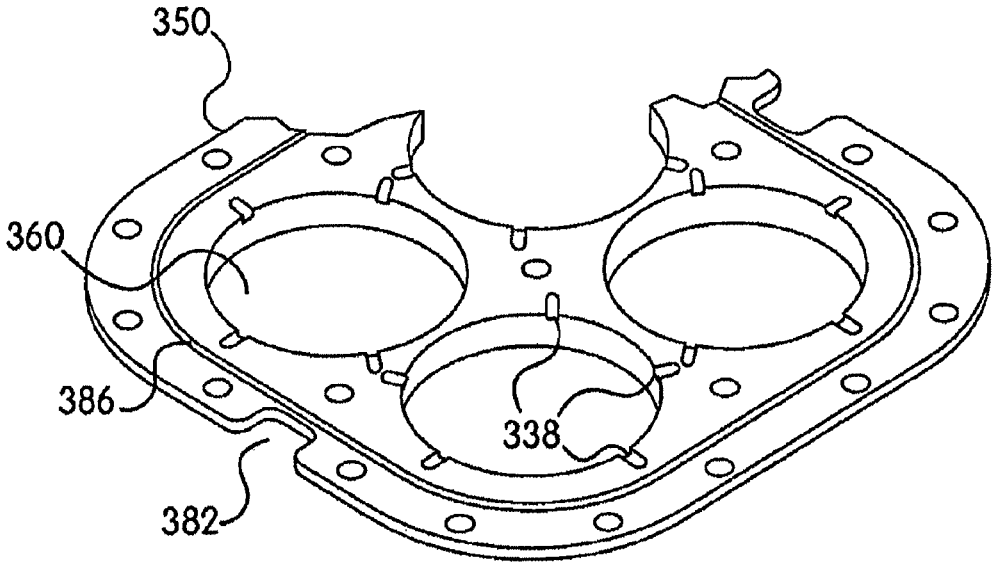
FIGS. 21 and 22 are enlarged isometric views of the tuning plate and upper plate shown in FIGS. 19 and 20.
Figure 22:
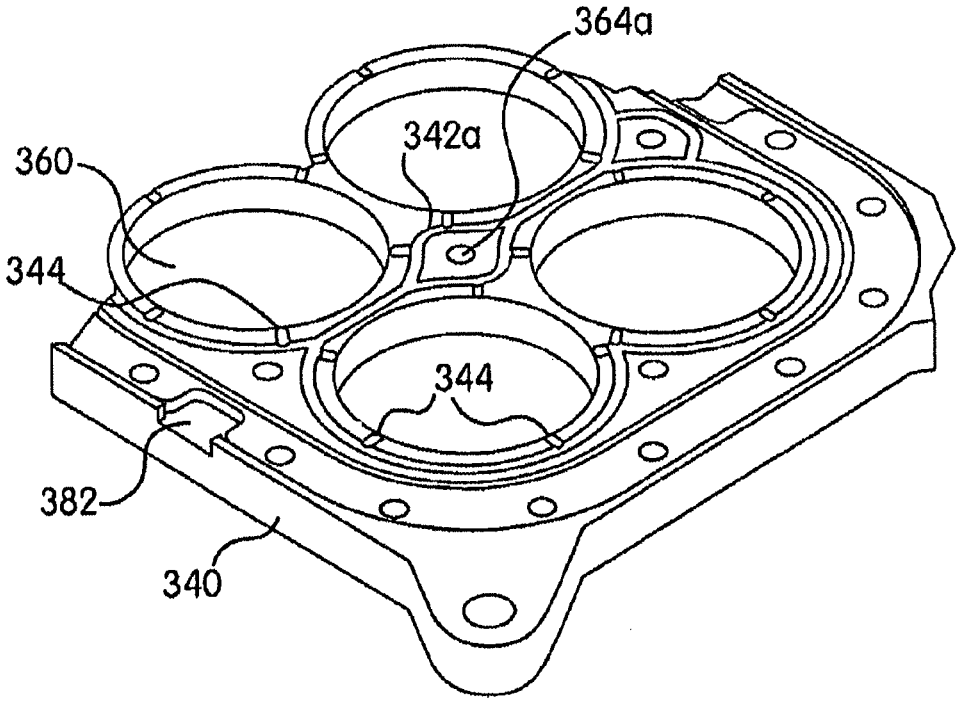

In FIGS. 19 and 21, tuning plate 350 is seen to provide precisely dimensioned shallow grooves 338 that coincide with fuel/air gates 334, extending from adjacent the runners of the lower plate to the throttle bores 360. In FIG. 22 are seen the accelerant gates 344, preferably of the geometry shown in FIGS. 5, 7 and 11, each with a precisely dimensioned curved ball milled deflection surface.

Figure 23:
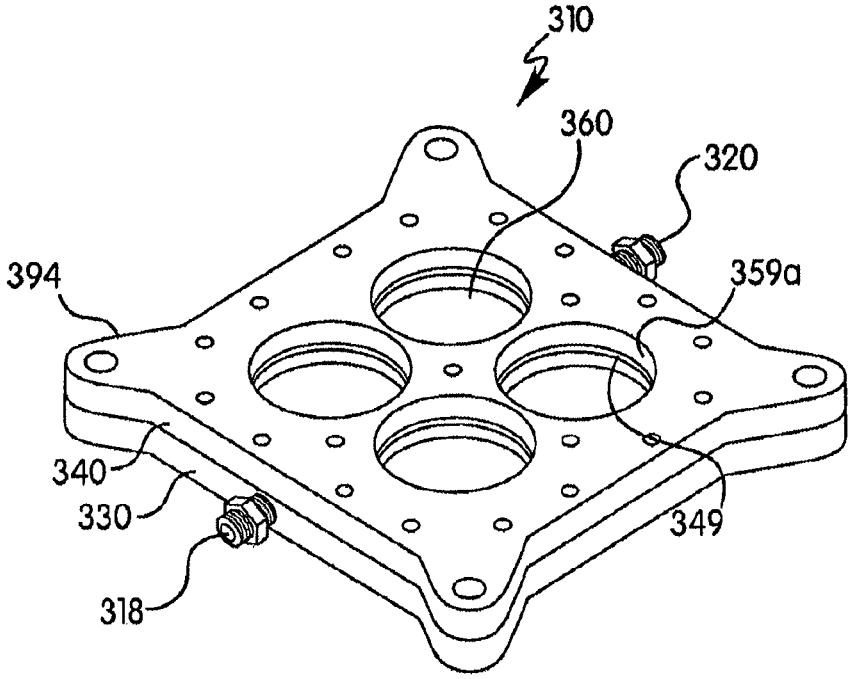
FIG. 23 is an isometric view of the injection billet of FIGS. 16 to 22 in an inverted position.

Now referring to FIG. 23, injection billet 310 is inverted, clearly showing the backsplash lips 359*a*,349*a* defined by the angled surfaces 336,356 of the lower plate 330 and the tuning plate 350, respectively, angled radially inwardly along the direction of downward air flow from the carburetor into the manifold.

The injection billets of the present invention are easily manufactured to be modular and of small total vertical height. Each of the lower and upper plates may for example have a respective thickness of 0.25 in for a total vertical billet height of 0.50 in. The tuning plate may have a thickness of 0.18 in, one-half of which is nested into respective recesses of the lower and upper plates, which recesses are of 0.09 in. Thus, the injection billet may easily be installed into an internal combustion engine between the carburetor and manifold with minimal increase in total engine/carburetor height and thus may easily be installed into pre-existing engines in a retrofit procedure.

Figure 24:
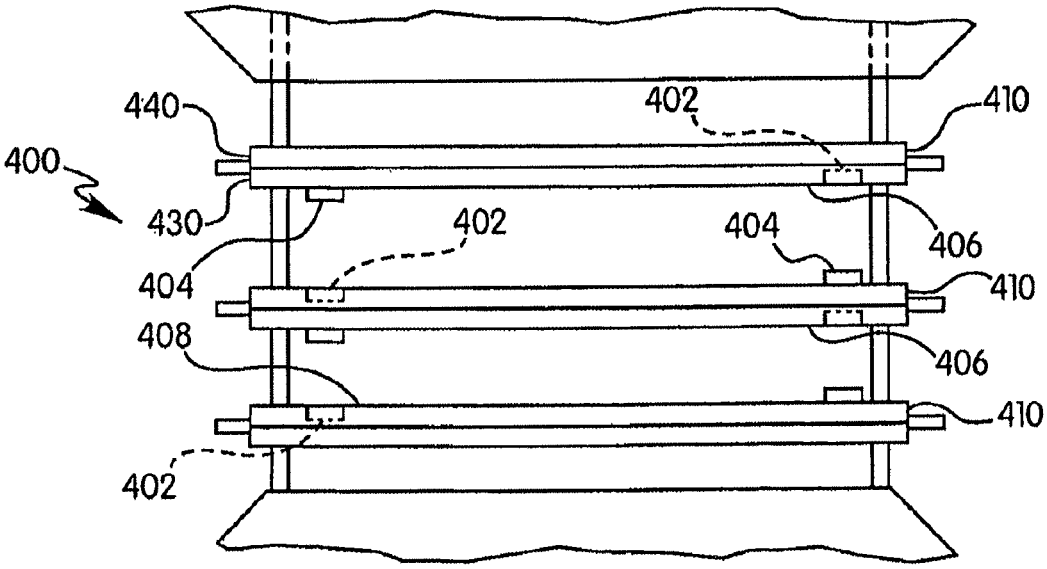
FIG. 24 is an elevation view of three injection billets to be stacked for sequential stage accelerant injection.

Furthermore, the modular nature and minimal vertical height of the injection billet of the present invention enables stacking of two or more such injection billets 410 in a single engine, as shown in FIG. 24, with each injection billet of stack 400 preferably being a self-contained functional unit with its own injection jets. Preferably, for such stacking, low height notches 402 and bosses 404 may be provided in pairs on opposite ends at the injection jets, in the bottom surface 406 of the lower plate 430 of each billet 410 (except the bottom-most billet of the stack) and the top surface 408 of the upper plate 440 (except the topmost billet of the stack) for assuring the maintenance of vertical alignment of the injection billets and relief of some stress on the bolts, and optionally aligning vertically the injection jet fittings of the plurality of billets, accelerant jet fittings along one side of the stack and fuel/air jet fittings along the opposite side. The injection billets of the stack 400 would be sequentially and automatically activated by sensors (not shown) during a race to provide great boosts of horsepower to the engine as vehicle speed or horsepower performance increases.

Figure 25:
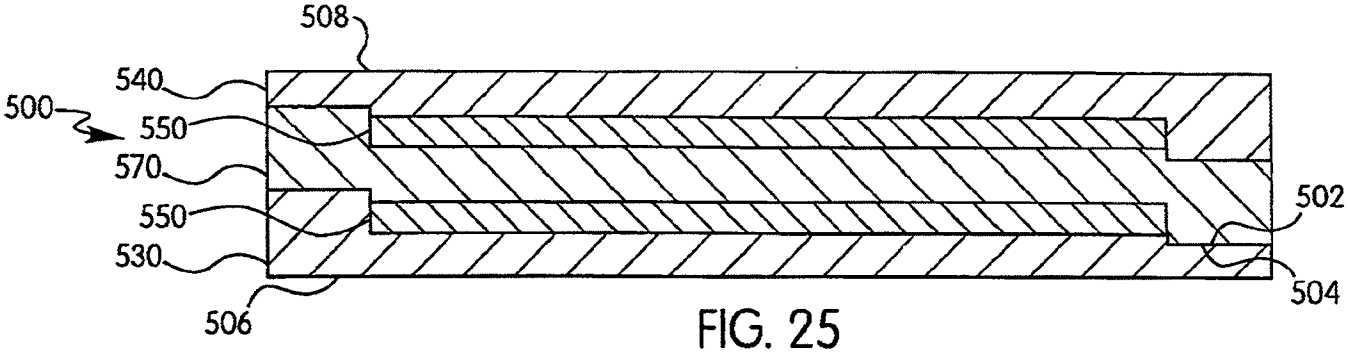
FIGS. 25 and 26 are cross-sectional views of a stack of plates for a multi-stage injection billet having a modified intermediate plate.
Figure 26:
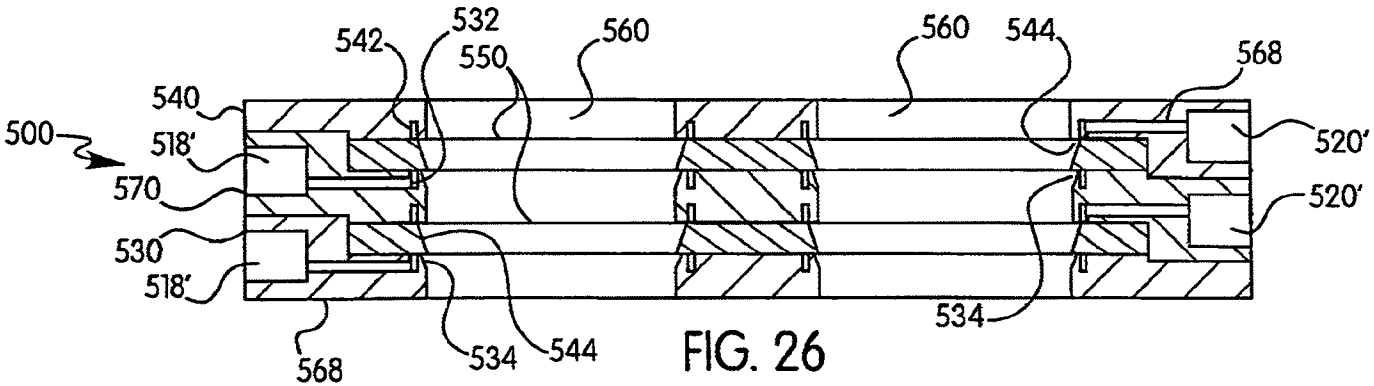
Figure 27:
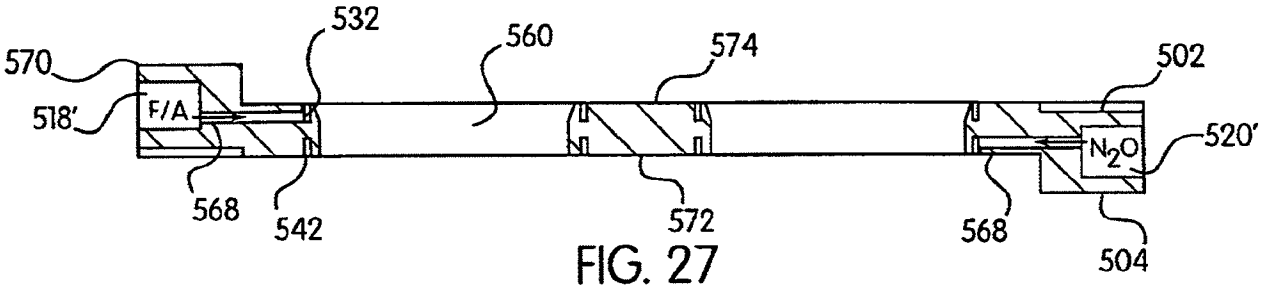
FIG. 27 is a cross-sectional view of the intermediate plate of FIGS. 25 and 26.

Another embodiment of a multi-stage injection billet 500 is illustrated in FIGS. 25 to 27, having a lower outer surface 506 and an upper outer surface 508, bosses 502 and notches 504 for plate nesting, and injection inlet ports 518' and 520' and respective transfer passageways 568 for fuel/air and accelerant, respectively. Billet 500 includes a lower plate 530 and an upper plate 540 but also includes an intermediate plate 570. Intermediate plate 570, best seen in FIG. 27, is a hybrid of a lower plate and an upper plate by having lower and upper active surfaces 572, 574 that cooperate with the lower plate 530 and the upper plate 540, and runners 532,542 for fuel/air and accelerant, respectively, all to provide two stages of accelerant injection. Tuning plates 550 are also disposed between the lower plate 530 and intermediate plate 570 and between intermediate plate 570 and upper plate 540, as with the other embodiments of injection billets hereinabove described. Pairs of accelerant gates 544 and fuel/air gates 534 are provided at the interfaces of the tuning plate surfaces with the upper plate 540 and with the lower plate 530, and with the lower surface 572 of intermediate plate 570 and the upper surface 574 thereof. An advantage of this embodiment over that of FIG. 24 is that stack height is reduced by the thickness of one plate, or 0.25 in.

Figure 28:
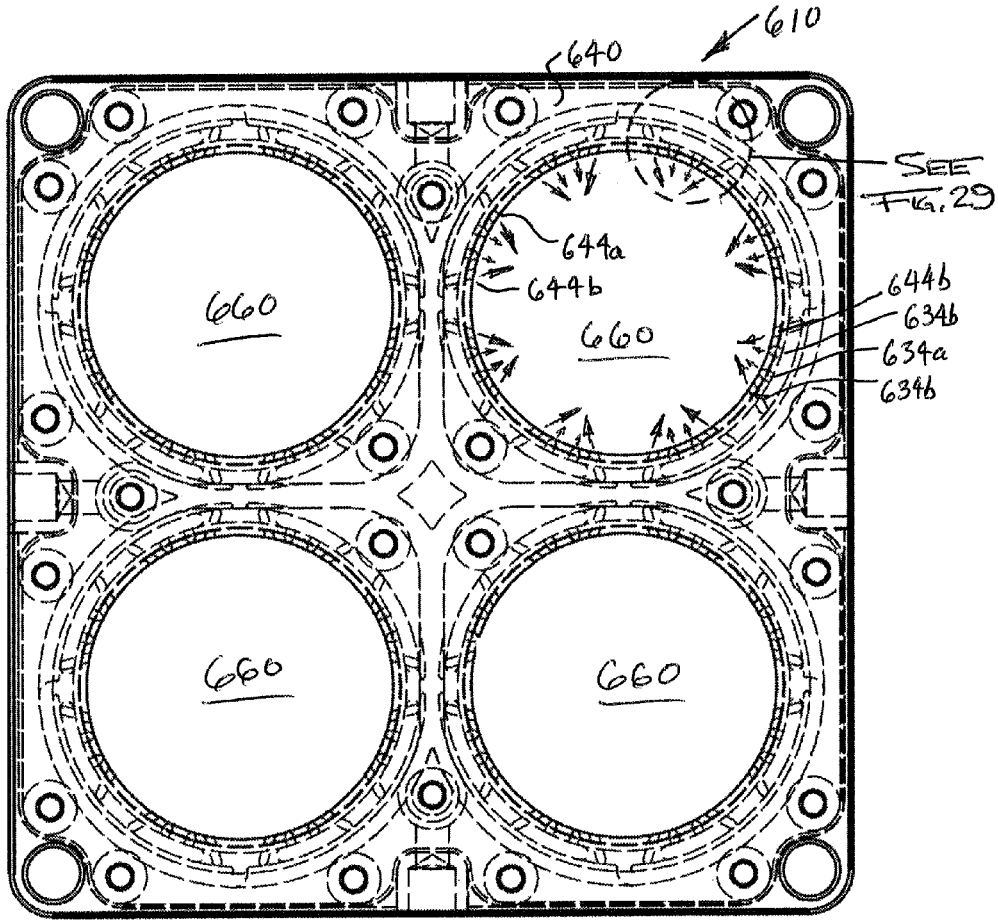
FIG. 28 is a top view of an alternate embodiment of the injection plate assembly having peripherally spaced apart groupings of gates in each main aperture, each grouping includes two accelerant gates located generally above and directed in a peripheral direction toward two fuel or fuel/air gates.
Figure 29:
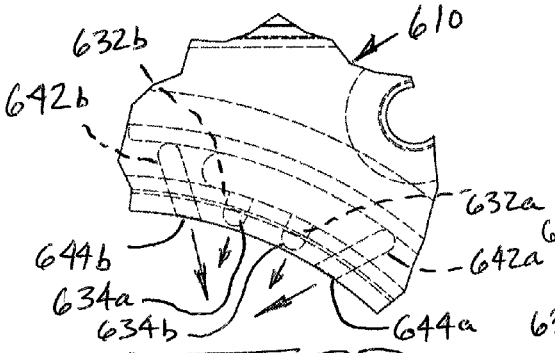
FIG. 29 is an enlarged detail taken from FIG. 28.
Figure 30:
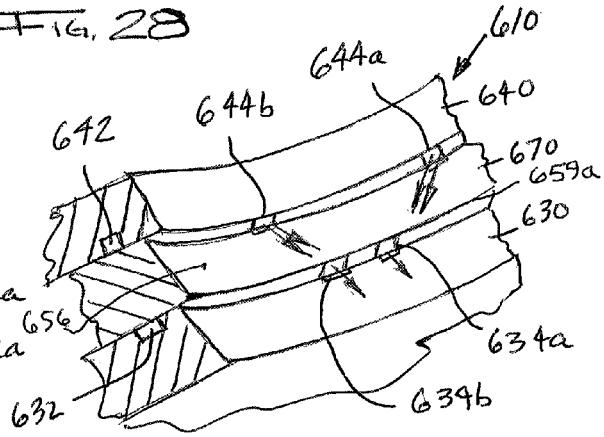
FIG. 30 is a partial perspective view of an inside of a main aperture showing the gate locations.

Referring to FIGS. 28-30, another embodiment of a plate assembly 610 is shown formed from an upper plate 640, intermediate plate 670, and lower plate 630, similar to the plates described above. Here, the fuel/air gates 634*a*, 634*b* and accelerant gates 644*a*, 644*b* are arranged in peripherally spaced apart groupings around the inner periphery of each of the main apertures 660. 8 groupings are provided around each main aperture 660 in the embodiment shown, but the number could be varied depending on the aperture size, flow rates, and particular application. As shown in detail in FIGS. 29 and 30, two accelerant gates 644*a*, 644*b* in each grouping are spaced apart from and not only directed downwardly, in a similar manner to the gates 44*a-d* described above, but are also peripherally angled toward the two fuel/air gates 634*a*, 634*b* located generally beneath and between the two accelerant gates 644*a*, 644*b*. The lip 659*a* formed by the angled surface 656 of the intermediate plate 670 protects the fuel/air gates 634*a*, 634*b* from direct impingement by the accelerant spray from the accelerant gates 644*a*, 644*b*, preventing inconsistent or sheared off flow of the low pressure fuel or fuel/air. The flow direction of the accelerant is indicated by the large arrows and the accelerant runners 642*a*, 642*b* coincide with the spray direction toward the fuel gate locations. Here, the fuel runners 632*a*, 632*b* are generally normal to an inner peripheral surface of each of the main apertures 660.

Figure 31:
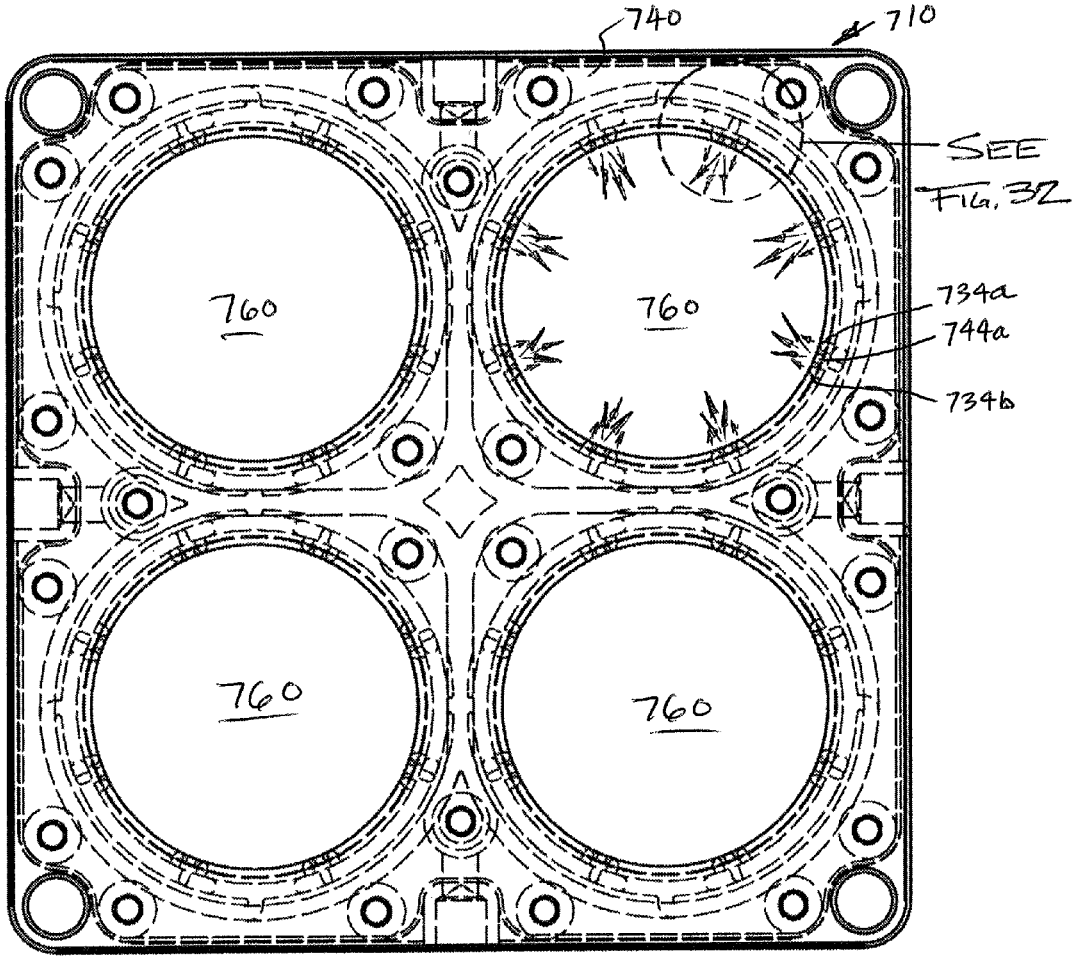
FIG. 31 is a top view of an alternate embodiment of the injection plate assembly having peripherally spaced apart groupings of gates in each main aperture, each grouping includes a single accelerant gate located generally above and directed toward two fuel or fuel/air gates.
Figure 32:
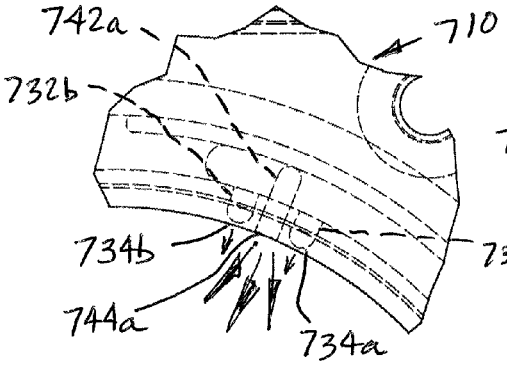
FIG. 32 is an enlarged detail taken from FIG. 31.
Figure 33:
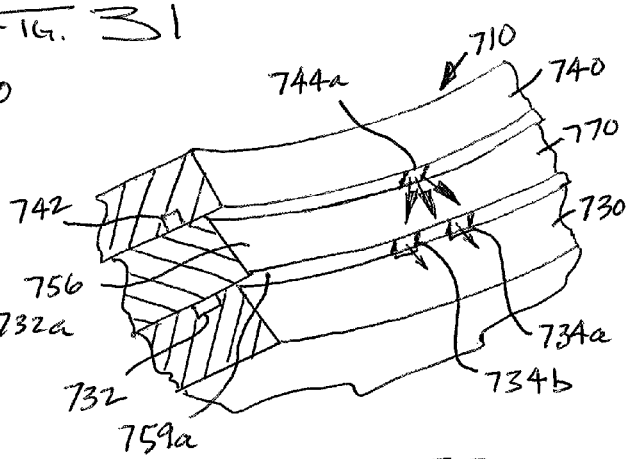
FIG. 33 is a partial perspective view of an inside of a main aperture showing the gate locations.

Referring to FIGS. 31-33, another embodiment of a plate assembly 710 is shown formed from an upper plate 740, intermediate plate 770, and lower plate 730, similar to the plates described above. Here, the fuel/air gates 734*a*, 734*b* and accelerant gate 744*a* are arranged in peripherally spaced apart groupings around the inner periphery of each of the main apertures 760. 8 groupings are provided around each main aperture 760 in the embodiment shown, but the number could be varied depending on the aperture size, flow rates, and particular application. As shown in detail in FIGS. 32 and 33, a single accelerant gate 744*a* in each grouping is directed downwardly, in a similar manner to the gates 44*a-d* described above, toward the two peripherally spaced apart fuel/air gates 734*a*, 734*b* located generally beneath and on either side of the accelerant gate 744*a*. The lip 759*a* formed by the angled surface 756 of the intermediate plate 770 protects the fuel/air gates 734*a*, 734*b* from direct impingement by the accelerant spray from the accelerant gate 744*a*, preventing inconsistent or sheared off flow of the low pressure fuel or fuel/air. The flow direction of the accelerant is indicated by the large arrows and the accelerant runner 742*a* coincides with the spray direction toward the fuel gate locations. Here, the fuel runners 732*a*, 732*b* leading to the gates 734*a*, 734*b* are generally normal to an inner peripheral surface of each of the main apertures 760.

Figure 34:
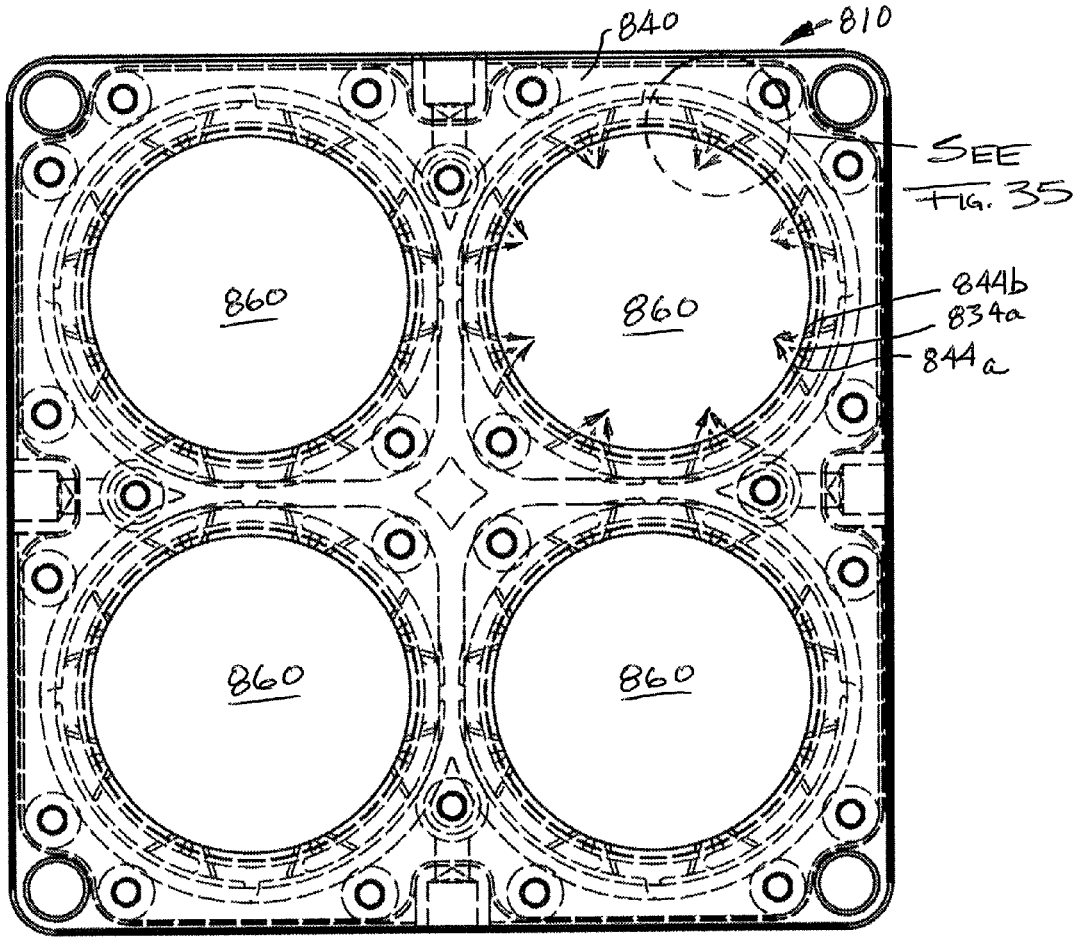
FIG. 34 is a top view of an alternate embodiment of the injection plate assembly having peripherally spaced apart groupings of gates in each main aperture, each grouping includes two accelerant gates located generally above and directed in a peripheral direction toward a single fuel or fuel/air gate.
Figure 35:
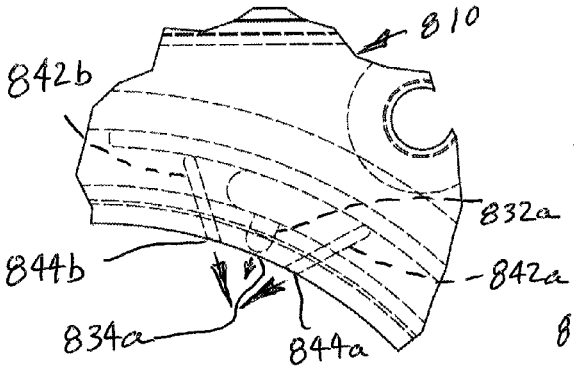
FIG. 35 is an enlarged detail taken from FIG. 34.
Figure 36:
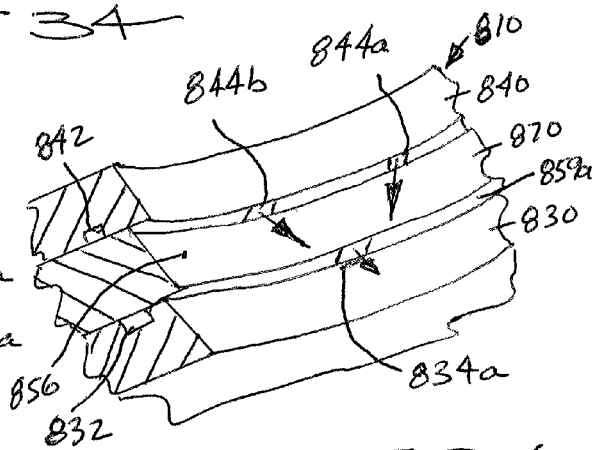
FIG. 36 is a partial perspective view of an inside of a main aperture showing the gate locations.

Referring to FIGS. 34-36, another embodiment of a plate assembly 810 is shown formed from an upper plate 840, intermediate plate 870, and lower plate 830, similar to the plates described above. Here, the fuel/air gate 834*a* and accelerant gates 844*a*, 844*b* are arranged in peripherally spaced apart groupings around the inner periphery of each of the main apertures 860. 8 groupings are provided around each main aperture 860 in the embodiment shown, but the number could be varied depending on the aperture size, flow rates, and particular application. As shown in detail in FIGS. 35 and 36, two accelerant gates 844*a*, 844*b* in each grouping are spaced apart from and not only directed downwardly, in a similar manner to the gates 44*a-d* described above, but are also peripherally angled toward the fuel/air gate 834*a* located generally beneath and between the two accelerant gates 844*a*, 844*b*. The lip 859*a* formed by the angled surface 856 of the intermediate plate 870 protects the fuel/air gate 834*a* from direct impingement by the accelerant spray from the accelerant gates 844*a*, 844*b*, preventing inconsistent or sheared off flow of the low pressure fuel or fuel/air. The flow direction of the accelerant is indicated by the large arrows and the accelerant runners 842*a*, 842*b* coincide with the spray direction toward the fuel gate locations. Here, the fuel runner 832*a* is generally normal to an inner peripheral surface of each of the main apertures 860. The two streams of accelerant from the gates 844*a*, 844*b*, enhance the atomization of the fuel or fuel/air mixture from the gate 834*a*, and more rapidly expand the accelerant—fuel mixture in the bore in the intake manifold.

Figure 37:
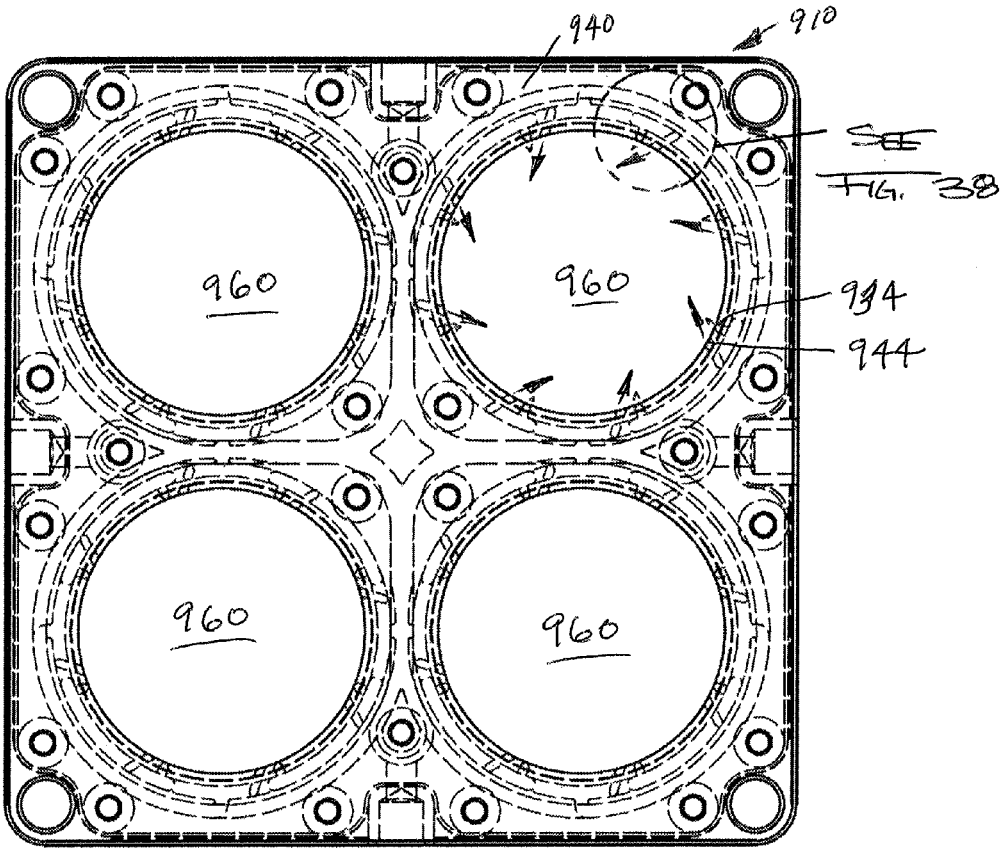
FIG. 37 is a top view of an alternate embodiment of the injection plate assembly having peripherally spaced apart groupings of gates in each main aperture, each grouping includes an accelerant gate located generally above and directed in a peripheral direction toward a peripherally offset fuel or fuel/air gate to provide a swirling effect.
Figure 38:
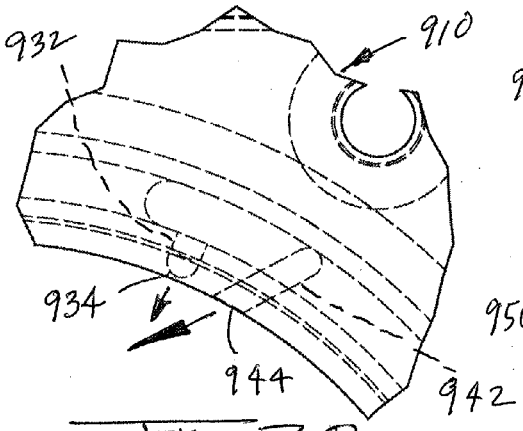
FIG. 38 is an enlarged detail taken from FIG. 37.
Figure 39:
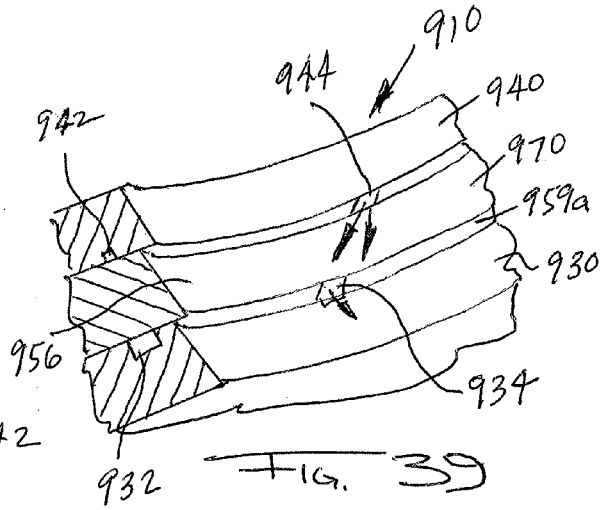
FIG. 39 is a partial perspective view of an inside of a main aperture showing the gate locations.

Referring to FIGS. 37-39, another embodiment of a plate assembly 910 is shown formed from an upper plate 940, intermediate plate 970, and lower plate 930, similar to the plates described above. Here, the fuel/air gate 934 and accelerant gate 944 are arranged in peripherally spaced apart groupings around the inner periphery of each of the main apertures 960. 8 groupings are provided around each main aperture 960 in the embodiment shown, but the number could be varied depending on the aperture size, flow rates, and particular application. As shown in detail in FIGS. 38 and 39, the accelerant gate 944 in each grouping is spaced apart in a peripheral direction from the fuel air gate 934, and is not only directed downwardly, in a similar manner to the gates 44*a-d* described above, but is also peripherally angled toward the fuel/air gate 934 located generally beneath it so that the accelerant intersects the fuel/air flow from the gate 934 and imparts a swirling effect based on the angle of the accelerant gate 944 in the peripheral direction. This angle is preferably in the range of 45° to 75° from the peripheral surface. The lip 959*a* formed by the angled surface 956 of the intermediate plate 970 protects the fuel/air gate 934 from direct impingement by the accelerant spray from the accelerant gates 944, preventing inconsistent or sheared off flow of the low pressure fuel or fuel/air. The flow direction of the accelerant is indicated by the large arrows and the accelerant runner 942 coincide with the spray direction toward the fuel gate locations. Here, the fuel runner 632 is generally normal to an inner peripheral surface of each of the main apertures 960.

The embodiments of the plate assembly 610, 710, 810, and 910 provide for increased fuel atomization through grouping the gates as noted, allowing for arrangements that may provide additional benefits with respect to power output with peripherally offset accelerant gate(s) and fuel or fuel/air gate(s) in each of the peripherally spaced apart groupings. Some or all of the groupings of gates can be the same or different, or groupings of gates as discussed in connection with the plate assemblies 610, 710, 810, 910 could be interspersed with vertically stacked pairs of gates, such as 44 and 34 discussed above.

The injection plate assemblies of the present invention can provide an additional horsepower increment at least 100 hp greater than prior art nitrous oxide injection systems. It has been found that for a single stage injection billet of the present invention, as measured by dynamometer testing apparatus, an increment of from 150 hp to 400 hp and greater can be achieved, for a conventional drag racing vehicle engine with a nominal horsepower rating of from 400 hp to about 1200 hp. Thus for a stack of three such billets, it is believed that additional horsepower can eventually total of about between 500 hp to 1200 hp or greater.

In the injection plate assemblies of the present invention, it has been observed that pressure seals are established inherently between the plates, with which O-ring seals are actually redundant. Between parallel finished surfaces of plates, seals develop from captive fluid (liquid or gas) therebetween such as from the runners of the plates, as the fluid is forced into and between the finished surfaces, including along microscopic marks that are artifacts of the manufacturing or machining processes, defining what may be termed a "dry seal", especially when the facing plate surfaces are machined in a radial end mill manner that creates overlapping patterns of swirls. Such a "dry seal" may be observed between plates of glass pressed together and having water therebetween. It is preferred for the present invention that plate surfaces be finished with a Root Mean Square roughness (RMS) surface finish of 2 to 125 μin, and more preferably from 8 to 32 μin, from milling, grinding, turning, lapping or surface treatments, to engage the fluid sealing agent without leakage. Surface treatment with the desired roughness can be attained by providing the surfaces of the lower and upper and tuner plates with polymer coatings such as with polytetrafluoroethylene resin.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An injection plate assembly for an internal combustion engine that includes a manifold and a carburetor, for injection of a primary fuel into each throttle bore of the manifold having at least one throttle bore, and for injection of a secondary fuel thereinto for admixture with the primary fuel, comprising:

an assembly including a lower plate having a lower surface to be adjacent a manifold, an upper plate having an upper surface to be adjacent a carburetor, and an intermediate plate interposed between the lower plate and the upper plate, the assembly having at least one aperture therethrough aligned with each respective throttle bore;

the lower plate including an inlet port for the primary fuel, and a runner in fluid communication with the inlet port and extending to an array of primary injection gates about each of the at least one apertures of the assembly;

the upper plate including an inlet port for the secondary fuel, and a runner in fluid communication with the inlet port and extending to an array of secondary injection gates about each at least one aperture of the assembly;

one or more of the secondary injection gates of the upper plate being associated with one or more respective primary injection gates of the lower plate to define peripherally spaced apart groupings of gates located around the at least one aperture, in each of the groupings of gates, at least one of the secondary gates is peripherally offset from at least one of primary gates that is positioned thereabove, with the at least one of the primary gates being oriented in a direction toward the at least one primary gate in the grouping of gates; and the secondary injection gates each defining a discharge angle for the secondary liquid distinctly downwardly into the throttle bore associated with each of the at least one apertures while the primary injection gates each discharge the primary fuel into an atomized spray plume of secondary liquid discharged from the associated secondary injection gate or gates, whereby the primary fuel is also atomized and induced into the throttle bore.

2. The injection plate assembly of claim 1, wherein the intermediate plate forms a lip around the at least one aperture that extends over the primary injection ports.

3. The injection plate assembly of claim 2, wherein the intermediate plate includes an angled surface about the at least one aperture that forms the lip.

4. The injection plate assembly of claim 3, wherein the lower plate includes an angled surface about the at least one aperture.

5. The injection plate assembly of claim 2, wherein the lip acts as an anti-reversion device.

6. The injection plate assembly of claim 1, wherein at least some of the peripherally spaced apart groupings of gates include two of the secondary gates that are peripherally spaced apart from one another, and two of the primary gates located between the secondary gates, the secondary gates being angled peripherally toward the primary gates.

7. The injection plate assembly of claim 1, wherein at least some of the peripherally spaced apart groupings of gates include two of the secondary gates that are peripherally spaced apart from one another, and one of the primary gates located between the secondary gates, the secondary gates being angled peripherally toward the primary gate.

8. The injection plate assembly of claim 1, wherein at least some of the peripherally spaced apart groupings of gates include one of the secondary gates that is located between two peripherally spaced apart ones of the primary gates.

9. The injection plate assembly of claim 1, wherein at least some of the peripherally spaced apart groupings of gates include one of the secondary gates that is peripherally spaced apart from one of the primary gates, with the secondary gate being angled in a peripheral direction toward the primary gate, such that discharge of accelerant through the secondary gate induces a swirl in the flow through the at least one aperture.

* * * * *